US010766293B2

(12) United States Patent
Lister

(10) Patent No.: US 10,766,293 B2
(45) Date of Patent: Sep. 8, 2020

(54) METHODS OF MANUFACTURING A SECURITY DEVICE

(71) Applicant: DE LA RUE INTERNATIONAL LIMITED, Basingstoke, Hampshire (GB)

(72) Inventor: Adam Lister, Andover (GB)

(73) Assignee: DE LA RUE INTERNATIONAL LIMITED, Basingstoke (GB)

( * ) Notice: Subject to any disclaimer, the term of this patent is extended or adjusted under 35 U.S.C. 154(b) by 0 days.

(21) Appl. No.: 16/316,435

(22) PCT Filed: Jul. 4, 2017

(86) PCT No.: PCT/GB2017/051962
§ 371 (c)(1),
(2) Date: Jan. 9, 2019

(87) PCT Pub. No.: WO2018/011546
PCT Pub. Date: Jan. 18, 2018

(65) Prior Publication Data

US 2019/0275824 A1 Sep. 12, 2019

(30) Foreign Application Priority Data

Jul. 15, 2016 (GB) ..... 1612290.5

(51) Int. Cl.
*B42D 25/342* (2014.01)
*B42D 25/45* (2014.01)
(Continued)

(52) U.S. Cl.
CPC ..... *B42D 25/342* (2014.10); *B42D 25/425* (2014.10); *B42D 25/45* (2014.10);
(Continued)

(58) Field of Classification Search
USPC ..... 283/67, 70, 72, 74, 75, 77, 94, 98, 901
See application file for complete search history.

(56) References Cited

U.S. PATENT DOCUMENTS 6,856,462 B1 2/2005 Scarbrough et al.
2009/0297805 A1 12/2009 Dichtl
(Continued)

FOREIGN PATENT DOCUMENTS

CN 102666124 A 9/2012
CN 103081478 A 5/2013
(Continued)

OTHER PUBLICATIONS

Jan. 17, 2017 Search Report issued in Great Britain Patent Application No. 1612290.5.
(Continued)

*Primary Examiner* — Justin V Lewis
(74) *Attorney, Agent, or Firm* — Oliff PLC

(57) ABSTRACT

A method of manufacturing a security device includes: a) providing a depth map of a macroimage depicting a three-dimensional object, the depth map representing the depth of each part of the three-dimensional object relative to a reference plane by different colours and/or different tones of one colour; b) segmenting the depth map into a plurality of regions based on the colours and/or tones of the depth map; c) for each region, creating a respective microimage element array; and d) providing a sampling element array of a predetermined pitch and orientation. The pitch and/or orientation of each respective microimage element array is different, and is configured such that the magnified versions of the microimage elements generated in any one of the regions have a different apparent depth relative to those generated in the other region(s), so as to form a three-dimensional representation of the macroimage.

19 Claims, 10 Drawing Sheets

(51) Int. Cl.

| | |
|---|---|
| ***B42D 25/425*** | (2014.01) |
| ***B42D 25/29*** | (2014.01) |
| ***B42D 25/24*** | (2014.01) |
| ***B42D 25/23*** | (2014.01) |
| ***B42D 25/324*** | (2014.01) |

(52) U.S. Cl.
CPC ..... *B42D 25/23* (2014.10); *B42D 25/24* (2014.10); *B42D 25/29* (2014.10)

(56) References Cited

U.S. PATENT DOCUMENTS

| | | | | |
|---|---|---|---|---|
| 2010/0177094 | A1* | 7/2010 | Kaule | B44F 1/10 283/72 |
| 2012/0229368 | A1 | 9/2012 | Watanabe et al. | |
| 2013/0050819 | A1* | 2/2013 | Holmes | B42D 25/324 359/463 |

FOREIGN PATENT DOCUMENTS

| | | | |
|---|---|---|---|
| CN | 104191860 | A | 12/2014 |
| CN | 103236222 | B | 12/2015 |
| CN | 103608186 | B | 5/2016 |
| EP | 0 059 056 | A1 | 9/1982 |
| EP | 0 860 298 | A2 | 8/1998 |
| EP | 1 398 174 | A1 | 3/2004 |
| EP | 2 460 667 | A2 | 6/2012 |
| EP | 2587812 | A2 | 5/2013 |
| GB | 2539390 | A | 12/2016 |
| JP | H09318910 | A | 12/1997 |
| WO | 83/00659 | A1 | 3/1983 |
| WO | 94/27254 | A1 | 11/1994 |
| WO | 95/10419 | A1 | 4/1995 |
| WO | 95/10420 | A1 | 4/1995 |
| WO | 00/39391 | A1 | 7/2000 |
| WO | 03/054297 | A2 | 7/2003 |
| WO | 03/095188 | A2 | 11/2003 |
| WO | 2005/052650 | A2 | 6/2005 |
| WO | 2005/106601 | A2 | 11/2005 |
| WO | 2005/115119 | A2 | 12/2005 |
| WO | 2008/000350 | A1 | 1/2008 |
| WO | 2011/029602 | A2 | 3/2011 |
| WO | 2011/051668 | A1 | 5/2011 |
| WO | 2011/102800 | A1 | 8/2011 |
| WO | 2011/107782 | A1 | 9/2011 |
| WO | 2011/107783 | A1 | 9/2011 |
| WO | 2011/107788 | A1 | 9/2011 |
| WO | 2012/027779 | A1 | 3/2012 |
| WO | 2012153106 | A1 | 11/2012 |
| WO | 2014/070079 | A1 | 5/2014 |
| WO | 2017/194911 | A1 | 11/2017 |

OTHER PUBLICATIONS

Jan. 5, 2018 Search Report issued in Great Britain Patent Application No. 1710689.9.

Hutley et al., "The Moire Magnifier." Pure Appl. Opt.3, 1994, pp. 133-142.

Sep. 1, 2017 Search Report issued in International Patent Application No. PCT/GB2017/051962.

Sep. 1, 2017 Written Opinion of the International Searching Authority issued in International Patent Application No. PCT/GB2017/051962.

* cited by examiner

METHODS OF MANUFACTURING A SECURITY DEVICE

This invention relates to security devices, for example for use on articles of value such as banknotes, cheques, passports, identity cards, certificates of authenticity, fiscal stamps and other documents of value or personal identity. Methods of manufacturing such security devices are also disclosed.

Articles of value, and particularly documents of value such as banknotes, cheques, passports, identification documents, certificates and licences, are frequently the target of counterfeiters and persons wishing to make fraudulent copies thereof and/or changes to any data contained therein. Typically such objects are provided with a number of visible security devices for checking the authenticity of the object. Examples include features based on one or more patterns such as microtext, fine line patterns, latent images, venetian blind devices, lenticular devices, moiré interference devices and moiré magnification devices, each of which generates a secure visual effect. Other known security devices include holograms, watermarks, embossings, perforations and the use of colour-shifting or luminescent/fluorescent inks. Common to all such devices is that the visual effect exhibited by the device is extremely difficult, or impossible, to copy using available reproduction techniques such as photocopying. Security devices exhibiting non-visible effects such as magnetic materials may also be employed.

One class of security devices are those which produce an optically variable effect, meaning that the appearance of the device is different at different angles of view. Such devices are particularly effective since direct copies (e.g. photocopies) will not produce the optically variable effect and hence can be readily distinguished from genuine devices. Optically variable effects can be generated based on various different mechanisms, including holograms and other diffractive devices, and also devices which make use of sampling elements such as lenses or masking screens, including moiré magnifier devices and so-called lenticular devices.

Moiré magnifier devices (examples of which are described in EP-A-1695121, WO-A-94/27254, WO-A-2011/107782 and WO2011/107783) typically make use of an sampling grid in the form of an array of micro-focusing elements (such as lenses or mirrors) and a corresponding array of microimage elements, wherein the pitches of the micro-focusing elements and the array of microimage elements and their relative locations are such that the array of micro-focusing elements cooperates with the array of microimage elements to generate a magnified version of the microimage elements due to the moiré effect. Each microimage element is a complete, miniature version of the image which is ultimately observed, and the array of focusing elements acts to select and display a small portion of each underlying microimage element, which portions are combined by the human eye such that the whole, magnified image is visualised. This mechanism is sometimes referred to as "synthetic magnification". The same effect can be achieved through the use of other types of sampling grid such as masking grids in which the portions of the microimages displayed to the viewer are selected by transparent gaps (e.g. dots or lines) in an otherwise opaque layer.

New security devices with different appearances and effects are constantly sought in order to stay ahead of would-be counterfeiters.

In accordance with the present invention, a method of manufacturing a security device comprises:

a) providing a depth map of a macroimage depicting a three-dimensional object, the depth map representing the depth of each part of the three-dimensional object relative to a reference plane by means of different colours and/or different tones of one colour;

b) segmenting the depth map into a plurality of regions based on the colours and/or tones of the depth map, each region comprising those part(s) of the depth map having a colour or tonal value within a respective predetermined range;

c) for each region, creating a respective microimage element array, the microimage elements forming the microimage element array being arranged on a regular grid in one or two dimensions with a pitch and orientation which are constant across the region, the periphery of the microimage element array substantially matching that of the region, the resulting plurality of microimage element arrays being arranged relative to one another in the positions of the respective regions in the depth map to form a first image layer; and d) providing a sampling element array of a predetermined pitch and orientation, the sampling element array overlapping the plurality of microimage element arrays, wherein the pitches of the sampling element array and of the microimage element arrays and their relative locations are such that the sampling element array cooperates with each of the microimage element arrays to generate magnified versions of the microimage elements in each region due to the moiré effect;

wherein the pitch and/or orientation of each respective microimage element array is different, and is configured such that the magnified versions of the microimage elements generated in any one of the regions have a different apparent depth relative to those generated in the other region(s), so as to form a three-dimensional representation of the macroimage.

By segmenting a depth map of a macroimage into regions in this way and allocating a different microimage element array to each region, each with a different pitch (i.e. spacing between adjacent microimage elements) and/or orientation (i.e. rotational position in the plane of the device), the magnified versions of the microimages that will be generated when viewed in combination with the sampling element array will appear at different depths (in the direction normal to the device plane) in each region, due to the moiré magnification mechanism. Thus, each region will appear to lie flat and parallel to the plane of the device, but in combination a three-dimensional effect will be exhibited as the various regions sit at different apparent depths from one another, thereby recreating the appearance of the three-dimensional object depicted in the macroimage. This results in a security device with a highly distinctive and easily describable appearance which is extremely challenging for a would-be counterfeiter to imitate and therefore has a high security level. As the device is tilted, depending on the size of the microimages and the degree of magnification, the magnified versions of the microimages may also appear to move laterally within each region, although this effect may not be strongly visible in practice and indeed the size and shape of the microimages may preferably be selected to minimise the visual impact of this movement effect so as not to detract from the overall three-dimensional appearance of the security device.

The first image layer produced in the above manner will typically be of a single colour (that is, all of the microimage elements in all the regions will be of the same colour and the surrounding background will be colourless, or vice versa) since it is extremely difficult to achieve the high-resolution that is required of the microimage elements in multiple colours. Therefore, by itself, the three-dimensional representation of the object generated by the first image layer in combination with the sampling element array will typically be of a single colour too. To increase the complexity and visual impact of the device, the method therefore preferably further comprises providing a second image layer in the form of a multi-coloured or multi-tonal version of the macroimage, and overlapping the second image layer with the first image layer so as to provide the three-dimensional representation of the macroimage with a multi-coloured or multi-tonal appearance. The second image layer effectively "colours in" the three-dimensional representation formed by the first image layer.

It should be noted that the multi-coloured or multi-tonal version of the macroimage formed by the second image layer may exhibit the three-dimensional object with a different level of detail as compared with the depth map (or with any original version of the macroimage from which the depth map might have derived). For example, the second image layer may comprise uniform blocks of colour with peripheries approximately corresponding to those of the depicted object, or contours thereof, without any additional detail showing specific features of the object which may be conveyed by the three-dimensional representation only. Alternatively, the multi-coloured or multi-tonal second image layer may convey a greater level of detail than that in the three-dimensional representation, e.g. showing features which are too small to be clearly defined by the plurality of regions.

Since the multiple colours or tones of the second image layer only need to convey the image at a macroscale, very high resolution between the different colours or tones is not required. As such, the second image layer can be formed using any conventional technique and is not limited to fine-line processes. Effectively, the provision of multiple colours or tones in the security element is achieved separately from the creation of the optically variable effect (carried by the first image layer), although in the finished device the appearance is of an multi-coloured or multi-tonal, three-dimensional object and hence the two aspects appear to the observer (and would-be counterfeiter) to be fully integrated with one another.

Preferably, the second image layer is registered to the first image layer. This ensures that the correct parts of the three dimensional representation receive the intended colour or tone when viewed in combination with the second image layer. However, this is not essential since in some cases achieving "false colour" may be acceptable and could provide a further distinctive feature. Where register is preferred, only coarse register is necessary (e.g. to about 100 microns) since registration errors below such levels will not be apparent to the naked eye.

In preferred implementations, the first image layer is located between the sampling element array and the second image layer. That is, the second image layer underlies and provides a background to the first image layer. Such arrangements permit the second image layer to be formed with a high optical density (assuming the device is to be viewed in reflection). Alternatively, if the second image layer is semi-transparent (as will be appropriate if the device is to be viewed in transmitted light), the order of the two image layers could be reversed. In all cases it is generally preferred that the microimage elements making up the first image layer are of high optical density, e.g. substantially opaque.

The depth map can be obtained in various ways, and may be pre-generated as part of a separate process, potentially by a different entity. For example, this could be done by a graphical artist using suitable image manipulation software such as Adobe Photoshop™, based either on a source image or on the three-dimensional object itself. However, in a preferred embodiment, the depth map is provided by obtaining a multi-coloured or multi-tonal macroimage depicting a three-dimensional object and converting it a depth map by allocating different colours or tones to different parts of the map in accordance with the three-dimensional shape of the object. That is, the present method may include an initial step of generating the depth map from an original macroimage. This could be performed manually or by suitably programmed software.

In preferred embodiments, the depth map is a greyscale depth map, lighter grey tones (including white) representing parts of the object closer to the viewer and darker grey tones (including black) representing parts of the object further from the viewer, or vice versa. The use of a greyscale depth map as opposed to a multi-coloured depth map or a multi-tonal depth map in another colour reduces the amount of data associated with the depth map and hence also the processing capacity required of any computer or processor tasked with carrying out steps of the present method, since no chromatic data is required.

The greater the number of regions into which the depth map is segmented, the greater the level of detail with which the object will be represented in three-dimensions by the security device. Therefore, in step (b) the depth map is preferably segmented into at least 3 regions, preferably at least 5 regions, more preferably at least 10 regions. The optimum number of regions will however also depend on the nature of the macroimage and particularly the size and shape of the regions since if these are too small they may not be distinguishable to the human eye in the final device and the apparent depth could appear "averaged out" across multiple regions.

In preferred embodiments, in step (b) the magnitude of the predetermined colour or tonal value range for each region is approximately equal. For example, where the depth map is a greyscale depth map with 255 grey level values, the tonal value range for the first region may be 0 to 25, that for the second region 26 to 50, and so on, up to a tenth region with grey levels 225 to 255, meaning that each of the regions has a tonal range of between 25 and 31 grey levels. In this way the various different parts of the three-dimensional object will all be represented with a similar level of detail in the finished security device. However in other cases it may be preferred to vary the magnitude of the tonal or colour value ranges, e.g. so that parts of the object which appear "closer" to the viewer are depicted by a greater number of regions (and hence higher detail) than those further away. This could be achieved by using regions of smaller colour or tonal value range closer to one end of the colour/tone spectrum used in the depth map, and regions of greater colour or tonal value range at the other—for instance the tonal value range for the first region may be 0 to 5, that for the second region 6 to 15, and so on, with regions of increasing colour/tonal range up to a tenth region with grey levels 200 to 255. Of course, any number of regions could be used and ten is only given as an example.

Similarly, the smaller the colour or tonal value range used to define each region, the greater the number of regions that will be generated and hence the greater the level of detail with which the three-dimensional object is represented. Therefore, preferably, in step (b), the predetermined colour or tonal value range for each region corresponds to no more than 30% of the overall colour or tonal value range across the whole depth map, preferably no more than 20%, more preferably no more than 10%. In the first example given above where each region in a greyscale depth map has a range of about 25 to 31 grey values, this corresponds to about 10% to 12% of the overall colour or tonal value range.

Preferably, the pitch and/or orientation of the microimage elements varies successively from one region to the next across at least a portion of the device. That is, the pitch will either increase from one region to the next across the portion of the device, or it will decrease, and/or the orientation will change in a continuous direction. In this way the adjacent regions of the device will together appear as a surface projecting towards or away from the viewer (although depending on the size of the regions the surface may be stepped rather than smooth). Of course, ultimately the apparent depth of each region and hence the pitch and orientation of its microimage elements will depend on the three-dimensional object to be depicted.

Similarly, the degree to which the pitch and/or orientation of the microimage elements varies between regions will depend on what relative depths the various regions need to appear at to recreate the three-dimensional image. However, in some preferred examples, the pitch and/or orientation of the microimage elements varies by preferably up to 5% from one region to another. In other examples, a pitch and/or orientation variation of up to 1% is sufficient.

The microimage elements themselves could take any desirable form. In preferred examples, in any one of the regions, the microimage array comprises microimage elements in the form of rectilinear lines, curvilinear lines, dots, geometric shapes, alphanumeric characters, text, logos, symbols or other graphics. It may be desirable, for instance, to arrange the microimage elements to convey an item of information, which may preferably be related to the three-dimensional object represented by the security device. For instance, the macroimage could depict a solid letter "A" and the microimage elements could each take the form of a letter "A". Alternatively where the device is to be used on a banknote or similar, the three-dimensional object could be a solid currency identifier symbol such as "£" and the microimage elements could each carry the denomination of the banknote, e.g. "10" so that the information conveyed overall is "£10". Alternatively still, the macroimage could for instance be a three dimensional portrait, e.g. of The Queen, and the microimage elements could comprise the text "QEII" (standing for Queen Elizabeth II). To increase the security level, the size of the microimages and the level of magnification achieved could be configured such that the magnified microimage elements are not discernible to the naked eye and require at least low level magnification to be legible.

The various regions could comprise microimage elements of different forms—e.g. the symbol "£" in some regions and the digit "5" in other regions—but in preferred embodiments, the plurality microimage arrays each comprise microimages of the same form. This avoids potential visual distraction which might otherwise be caused by the different microimages in different regions, and so helps to emphasise the three-dimensional image displayed by the security device as a whole.

The first image layer can be formed in a number of ways. In preferred embodiments, the first image layer is provided on the first surface of a substrate, preferably a transparent substrate. For instance, the substrate may preferably be a polymer substrate (monolithic or multi-layered) and could for example comprise any of polypropylene (preferably BOPP), polycarbonate, polyethylene, poly vinyl chloride or the like. The substrate could be of a thickness suitable for forming into a security article such as a security thread, strip, foil, insert or patch, e.g. typically around 20 to 40 microns, or could be of a greater thickness suitable for forming the substrate of a document such as a polymer banknote (or hybrid paper-polymer banknote), e.g. 60 to 100 microns. If the substrate is transparent, it can be used to provide (all or part of) the optical spacing between the first image layer and the sampling element array. Alternatively the first image layer could be formed on one substrate (which may or may not be transparent) and then affixed to a second substrate which carries the sampling element array on its opposite side.

As already mentioned, the first image layer is preferably monochromatic. This makes it possible to use a wide range of available techniques to form the microimage element arrays which make up the first image layer at the high level of resolution that will be necessary.

In some preferred embodiments, the first image layer is formed by printing, preferably in a single printed working. That is, the microimage elements are defined by ink (either as negative or positive indicia) and preferably by a single ink across the whole first image layer. Any suitable printing technique capable of achieving high resolution could be utilised, such as gravure printing, flexographic printing, lithographic printing or intaglio printing which, With careful design and implementation, such techniques can be used to print pattern elements with a line width of between 25 μm and 50 μm. For example, with gravure or wet lithographic printing it is possible to achieve line widths down to about 15 μm. Alternatively more specialised microprinting techniques can be utilised. For instance, one approach which has been put forward as an alternative to the printing techniques mentioned above is used in the so-called Unison Motion™ product by Nanoventions Holdings LLC, as mentioned for example in WO-A-2005052650. This involves creating pattern elements ("icon elements") as recesses in a substrate surface before spreading ink over the surface and then scraping off excess ink with a doctor blade. The resulting inked recesses can be produced with line widths of the order of 2 μm to 3 μm.

Still further alternative microprinting techniques involve the use of curable inks, and examples are known from US 2009/0297805 A1 and WO 2011/102800 A1. These disclose methods of forming micropatterns in which a die form or matrix is provided whose surface comprises a plurality of recesses. The recesses are filled with a curable material, a treated substrate layer is made to cover the recesses of the matrix, the material is cured to fix it to the treated surface of the substrate layer, and the material is removed from the recesses by separating the substrate layer from the matrix. Another suitable method of forming a micropattern is disclosed in WO 2014/070079 A1. Here it is taught that a matrix is provided whose surface comprises a plurality of recesses, the recesses are filled with a curable material, and a curable pickup layer is made to cover the recesses of the matrix. The curable pickup layer and the curable material are cured, fixing them together, and the pickup later is separated from the matrix, removing the material from the recesses. The pickup layer is, at some point during or after this process, transferred onto a substrate layer so that the pattern is provided on the substrate layer.

In other preferred embodiments, the microimage elements of the first image layer may be formed as grating structures, recesses or other relief patterns on a substrate. Suitable relief structures can be formed by embossing or cast-curing into or onto a substrate. Of the two processes mentioned, cast-curing provides higher fidelity of replication. A variety of different relief structures can be used as will described in more detail below. However, the image elements could be created by embossing/cast-curing the images as diffraction grating structures. Differing parts of the image could be differentiated by the use of differing pitches or different orientations of grating providing regions with a different diffractive colour. Alternative (and/or additional differentiating) image structures are anti-reflection structures such as moth-eye (see for example WO-A-2005/106601), zero-order diffraction structures, stepped surface relief optical structures known as Aztec structures (see for example WO-A-2005/115119) or simple scattering structures. For most applications, these structures could be partially or fully metallised to enhance brightness and contrast.

In still further preferred implementations, the first image layer may be formed by patterning of a metal layer (i.e. demetallisation). Examples of preferred techniques for forming microimage elements in a metal layer are disclosed in our British patent application no. 1510073.8. Particularly good results have been achieved through the use of a patterning roller (or other tool) carrying a mask defining the desired pattern, as described therein. A suitable photosensitive resist material is applied to a metal layer on a substrate and the exposed in a continuous manner to appropriate radiation through the patterned mask. Subsequent etching transfers the pattern to the metal layer, thereby defining the image elements.

In contrast, as mentioned above, the second image layer (if provided) need not be formed by a high resolution technique and hence in preferred examples is typically formed by printing, preferably in multiple printed workings of different colours. The registration between the different coloured inks of the various workings need only be sufficient such that any error is not immediately apparent to the human eye, e.g. 100 microns or less. Thus, any convenient digital or non-digital printing method could be used to form the second image layer, including gravure, flexographic, lithographic, intaglio and the like but also inkjet, screen printing, xerographic printing, laser printing, dye diffusion thermal transfer printing and the like.

In some embodiments, the complexity of the device could be further enhanced by varying the pitch and/or orientation of the sampling element array across the device. However, in more preferred examples, the pitch and orientation of the sampling element array is constant across all of the regions. As mentioned above, if the first image plane is provided on a first surface of a transparent substrate, the sampling element array may preferably be provided on the second surface of the substrate.

The sampling element array can take various forms. In particularly preferred examples, the sampling element array comprises a focussing element array, such as lenses or mirrors, defining a focal plane, and step (d) further comprises locating the first image layer in a plane substantially coincident with the focal plane of the focussing element array. The use of focussing elements as opposed to other forms of sampling element such as masking elements (discussed below) is preferred in order to maintain the brightness of the device, since sampling elements involving masking inevitably inhibit either the reflection or transmission of some of the light incident on the device.

Advantageously, the first and second image layers are both located in planes substantially coincident with the focal plane of the focussing element array. This not only ensures that the multi-coloured or multi-tonal version of the macroimage carried by the second image layer will also be substantially in focus (in addition to the three-dimensional representation), but means that the first and second image layers must be close together (preferably in contact) and hence any parallax between them will be minimal (or preferably non-existent).

The focussing elements forming the focussing element array could comprise lenses or mirrors. In some preferred examples, the focusing elements comprise microlenses such as spherical lenslets, cylindrical lenslets, plano-convex lenslets, double convex lenslets, Fresnel lenslets and Fresnel zone plates. In other preferred embodiments, the focusing elements comprise concave mirrors. Preferably, each focussing element has a width or diameter in the range 1 to 100 microns, preferably 1 to 50 microns and even more preferably 10 to 30 microns.

Nonetheless, effective results can still be achieved using other forms of sampling element array and hence in other preferred embodiments, the sampling element array comprises a mask element array, each mask element comprising at least one substantially opaque zone and at least one substantially transparent zone. Hence the mask element array could comprise, for example a periodic or quasi-periodic array of substantially opaque and substantially transparent regions (made up by the plurality of mask elements), typically arranged as a one dimensional line screen pattern or a two dimensional dot screen pattern. The term "transparent" means that light is transmitted through the transparent zones of the mask element array with low optical scattering such that the image elements of the artwork pattern can be viewed therethrough with minimal obscuration. Conversely, the term "opaque" means that light does not pass through the opaque zones such that the image elements cannot be viewed through the opaque zones.

Preferably, the mask element array comprises a line screen, the substantially opaque zones and the substantially transparent zones of the mask elements having the form of rectilinear or curvilinear lines and alternating in a first dimension. The width of the respective zones in the first dimension may or may not be equal. In other preferred embodiments, the mask element array comprises a dot grid, the substantially transparent zones of the mask elements having the form of dots arrayed in a first and a second dimension and being surrounded by the substantially opaque zones of the mask elements. The dots could take any desirable shape, including circles, squares, rectangles or even indicia.

Masking layers such as these can be formed of any suitably opaque material which can be laid down in a patterned manner, or patterned after deposition. In preferred examples, the substantially opaque zones of the mask element array comprise one or more layers of ink, metal or metal alloy. The mask element array can advantageously be formed for example by printing, or by patterning of a deposited layer, preferably through etching of the deposited layer. Alternative ways of patterning a deposited layer which could be used include the use of a washable ink or similar which is applied prior to deposition of the opaque layer and then removed with a suitable solvent for example, taking with it the portions of the opaque layer thereon.

The security device could be a one-dimensional or two-dimensional moiré magnifier. In the former case each microimage element array will be periodic in one dimension whereas in the latter case each microimage element array will be periodic in two dimensions. If the device is a one-dimensional moiré magnifier the sampling element array may also be periodic only in one dimension. However more preferably, whether the device operates in one or two dimensions, the sampling element array is periodic in two dimensions and may for example comprise spherical or aspherical focusing elements or a dot grid. In this case, for example, the sampling elements could be arranged in an orthogonal array (square or rectangular) or in a hexagonal array. In the case of a focussing element array, the periodicity of the focusing structure array and therefore maximum width of the individual focusing elements is related to the device thickness and is preferably in the range 5-200 microns, still preferably 10 to 70 microns, most preferably 20-40 microns, with preferred lens heights of 1 to 70 microns, still preferably 5 to 25 microns. The focusing elements can be formed in various ways, but are preferably made via a process of thermal embossing or cast-cure replication. Alternatively, printed focusing elements could be employed as described in U.S. Pat. No. 6,856,462. If the focusing elements are mirrors, a reflective layer may also be applied to the focussing surface.

Typical thicknesses of security devices according to the invention are 5 to 200 microns, more preferably 10 to 70 microns,. For example, devices with thicknesses in the range 50 to 200 microns may be suitable for use in structures such as over-laminates in cards such as drivers licenses and other forms of identity document, as well as in other structures such as high security labels.

Suitable maximum image element widths (related to the device thickness) are accordingly 25 to 50 microns respectively. Devices with thicknesses in the range 65 to 75 microns may be suitable for devices located across windowed and half-windowed areas of polymer banknotes for example. The corresponding maximum image element widths are accordingly circa 30 to 37 microns respectively. Devices with thicknesses of up to 35 microns may be suitable for application to documents such as paper banknotes in the form of slices, patches or security threads, and also devices applied on to polymer banknotes where both the sampling elements and the image elements are located on the same side of the document substrate.

The security level of the device can be further increased by incorporating one or more additional functional materials into the device, such as a fluorescent, phosphorescent or luminescent substance. In further examples, the device may also comprise a magnetic layer.

The present invention further provides a security device, comprising:

- a sampling element array defining a focal plane and having a predetermined pitch and orientation;
- a first image layer overlapping the sampling element array; and
- a second image layer overlapping the sampling element array and the first image layer and arranged such that the first and second image layers are viewed in combination with one another via the sampling element array, the second image layer comprising a multi-coloured or multi-tonal version of a macroimage depicting a three-dimensional object;
- wherein the first image layer comprises a plurality of regions each being formed of a respective microimage element array, the microimage elements forming the microimage element array within each region being arranged on a regular grid in one or two dimensions with a pitch and orientation which are constant across the region, the periphery of each microimage element array substantially matching that of the respective region;
- wherein the pitches of the sampling element array and of the microimage element arrays and their relative locations are such that the sampling element array cooperates with each of the microimage element arrays to generate magnified versions of the microimage elements in each region due to the moiré effect;
- wherein the pitch and/or orientation of each respective microimage element array is different, and is configured such that the magnified versions of the microimage elements generated in any one of the regions have a different apparent depth relative to those generated in the other region(s), so as to form a three-dimensional representation of the macroimage, the second image layer providing the three-dimensional representation of the macroimage with a multi-coloured or multi-tonal appearance.

The security device exhibits the visual effects already described above, including the multi-coloured or multi-tonal aspect contributed by the second image layer.

The security device is advantageously provided with any of the preferred features already introduced above. Most preferably, the security device is manufactured using the method disclosed above.

Also provided is a security article comprising a security device as described above, wherein the security article is preferably a security thread, strip, foil, insert, transfer element, label or patch.

Also provided is a security document comprising a security device as described above, or a security article as described above, wherein the security document is preferably a banknote, cheque, passport, identity card, driver's licence, certificate of authenticity, fiscal stamp or other document for securing value or personal identity.

Examples of methods, security devices, security articles and security documents in accordance with the present invention will now be described with reference to the accompanying drawings, in which.

Figure 7A:
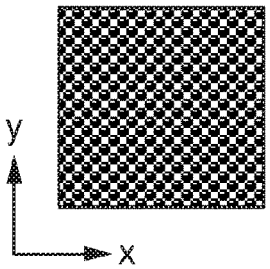
Figure 7B:
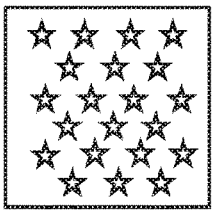
Figure 7C:
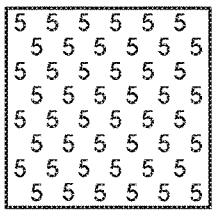
Figure 9A:
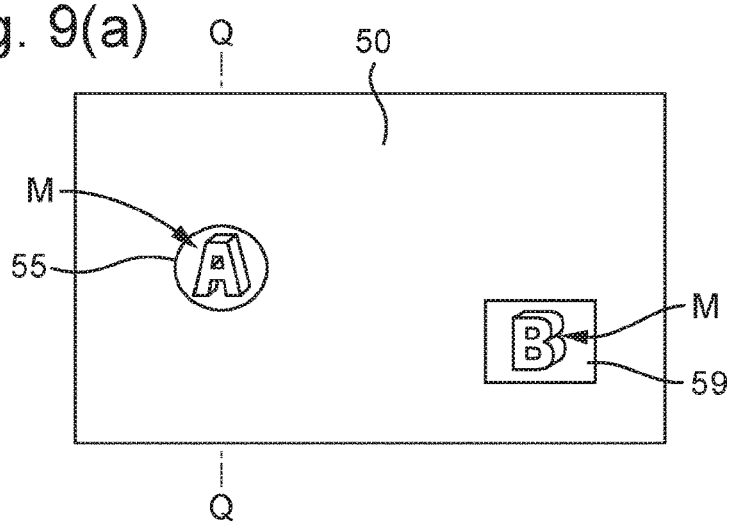
Figure 9B:
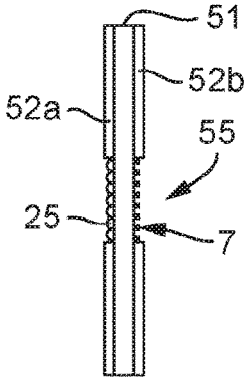
Figure 10A:
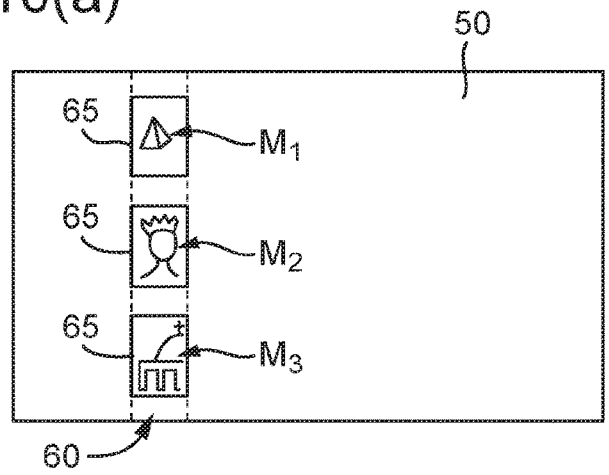
Figure 10B:
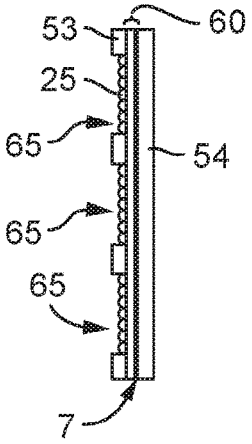
Figure 11A:
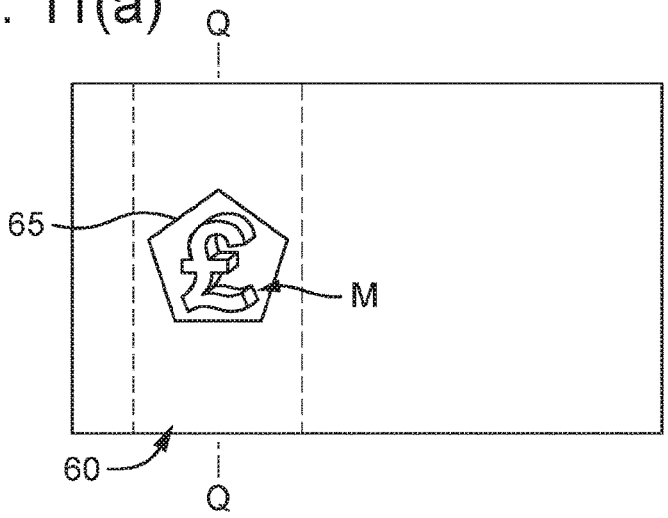
Figure 11B:
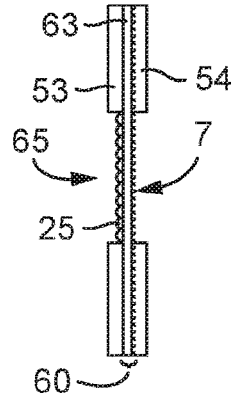
Figure 12A:
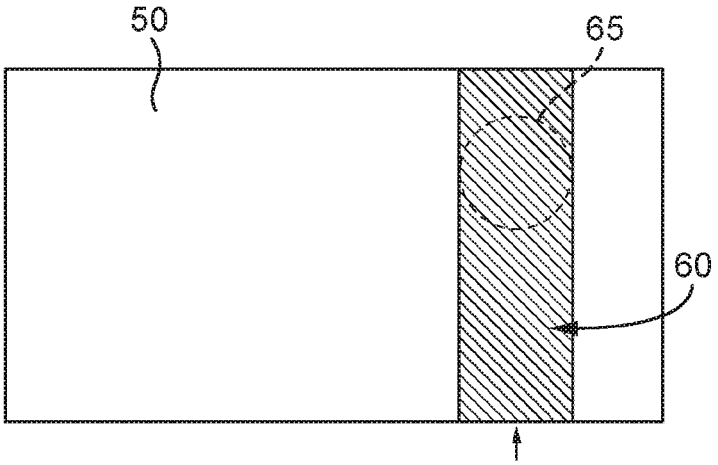
Figure 12C:
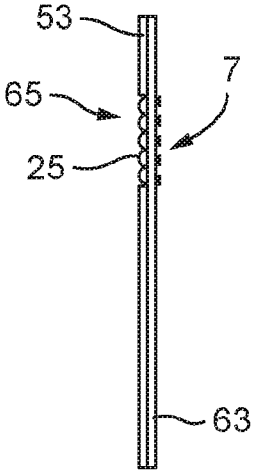
Figure 12B:
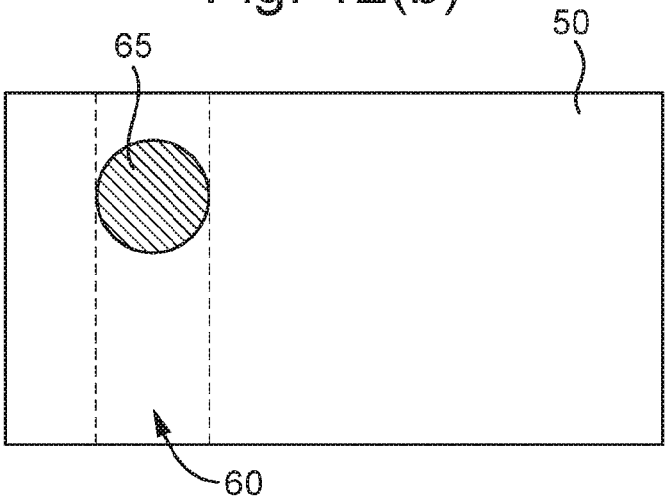

FIG. 3 depicts selected stages of the method of the first embodiment in an exemplary implementation, FIG. 3(*a*) showing an exemplary three-dimensional object, FIG. 3(*b*) showing a depth map of a macroimage depicting the three-dimensional object, FIG. 3(*c*) showing a segmented depth map, FIG. 3(*d*) showing a first image layer formed from the depth map and enlarged details (i) to (iv) of the first image layer, and FIG. 3(*e*) showing a plot representing the apparent depth of the magnified microimages exhibited by the finished security device along the line X-X';

FIGS. 4(*a*) to (*d*) show four exemplary security devices in accordance with embodiments of the invention, in cross-section;

FIG. 5 depicts selected stages of a method in accordance with a second embodiment of the present invention in another exemplary implementation, FIG. 5(*a*) showing a depth map of a macroimage depicting another exemplary three-dimensional object, FIG. 5(*b*) showing a segmented depth map, FIG. 5(*c*) showing a first image layer formed from the depth map, FIG. 5(*d*) showing an enlarged detail of the first image layer, and FIG. 5(*e*) showing a second image layer of the macroimage;

FIGS. 6(*a*) to (*d*) show four exemplary microimage arrays that may be provided in different regions of a first image layer in another embodiment of the invention;

FIGS. 7(*a*) to (*c*) show three further exemplary microimage arrays that may be utilised in other embodiments of the invention;

FIGS. 8*a* to 8*i* illustrate different examples of relief structures which may be used to define microimage elements in accordance with embodiments of the present invention;

FIGS. 9, 10 and 11 show three exemplary security documents carrying security devices in accordance with embodiments of the present invention, a) in plan view and b) in cross-section; and FIG. 12 illustrates a further embodiment of an security document carrying a security device in accordance with embodiments of the present invention, a) in front view, b) in back view and c) in cross-section.

Figure 1:
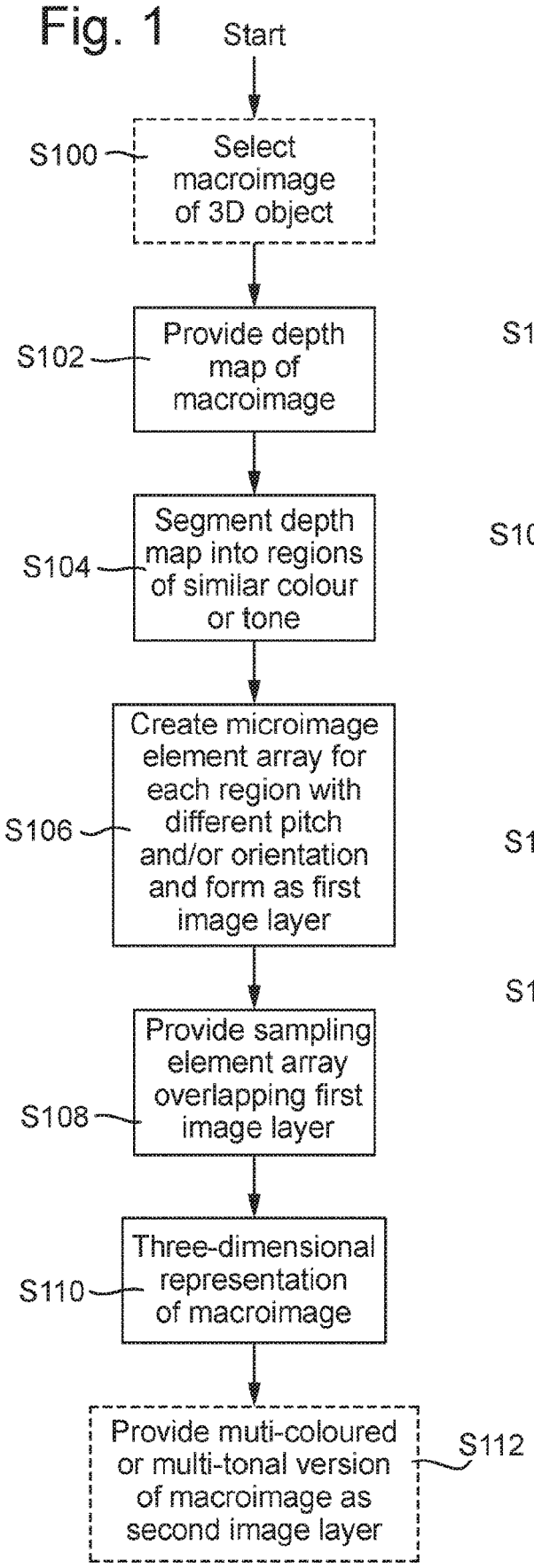
FIG. 1 is a flow chart depicting steps of a first embodiment of a method of manufacturing a security device in accordance with the invention.

A first embodiment of the invention will be described with reference to FIGS. 1, 2 and 3, the last of which depicts stages of the method using an exemplary macroimage of a three-dimensional (solid) letter "A". Of course, a macroimage of any three-dimensional object could be used, such as of a geometrical solid, a person, an animal, a building, a monument etc. The term "macroimage" is used to denote an image on a scale which is readily discernible to the naked eye without the need for magnification. For example, typical macroimages may have overall dimensions in the region of 3 mm to 10 cm, more preferably between 1 cm and 4 cm. Steps shown in dashed lines in FIG. 1 are optional, as are all the steps shown in FIG. 2.

The method begins either by obtaining a macroimage of a three-dimensional object, e.g. a full colour image of any scene or object having depth (step S100), such as a photograph, or alternatively may begin directly with the provision of a depth map of such a macroimage (step S102). A depth map represents the depth of each part of the object in the macroimage (i.e. its position along the normal to the plane of the image, relative to some reference plane) by means of the colour and/or tone of the corresponding part of the depth map. The depth map can either be pre-generated in some separate process (in which the present method begins at step S102), or may be obtained by converting the macroimage selected in step S100 into a depth map.

For instance, FIG. 3(*a*) shows an exemplary three-dimensional object 1, here a solid letter "A" which can be used as source material from which to draw a corresponding depth map 5 thereof, an example of which is shown in FIG. 3(*b*). Any available image manipulation software such as Adobe Photoshop™ can be used for this purpose. Alternatively, a photograph of the object 1 could be taken, constituting an initial macroimage, and converted into a depth map either by hand or using image recognition software. The depth map 5 could be multi-coloured and/or multi-tonal, e.g. representing parts of the object 1 which are further from the viewer (i.e. have the greatest "depth") using dark tones of a colour, and parts of the object 1 which are nearer to the viewer (i.e. have the shallowest "depth") using light tones of a colour, or vice versa. Any colour could be selected for this purpose but most preferably the depth map 5 is a greyscale depth map since in this case no chromatic data need be stored or manipulated and hence the capacity and processing demands on the processor performing the method are reduced. A depth map 5 may depict the object 1 utilising a certain number of colour or tonal levels, such as 255 grey levels in the case of a typical greyscale depth map. The greater the number of colour or tonal levels, the higher the resolution of the depth map and ultimately the more faithful the appearance of the three-dimensional object that will be achieved in the security device.

In the next step, the depth map 5 is segmented into a plurality of regions 10 according to the colour or tone of each part of the depth map 5 (step S104). Thus, each region 10 contains parts of the depth map (e.g. pixels) which are of a similar colour or tonal value to one another. This is achieved by selecting all those parts of the depth map having a colour or tonal value falling within a first predetermined range of colour or tonal values to form a first region, all those within a second such predetermined range to form a second region, and so on. Thus, in the example depicted in FIG. 3(*c*), the depth map 5 has been divided into four regions 10*a*, 10*b*, 10*c* and 10*d* to form segmented depth map 6. The first region 10*a* comprises all those parts of the depth map having low tonal values within a first range indicating that those parts of the object are near to the viewer, the second region 10*b* comprises all those parts of the depth map with higher tonal values falling into a second range, and so on. For example, in the case of a grey scale depth map 5 having 255 grey levels, the first region 10*a* may be allocated all parts of the depth map with a grey level between 0 and 65, the second region 10*b* those in the range 66 to 129, the third region 10*c* those in the range 130 to 190, and the fourth region 10*d* those in the range 191 to 255. Thus, a plurality of discrete, laterally offset, abutting regions 10 are formed as shown in FIG. 3(*c*).

The segmenting process can be performed by suitable image processing software such as using the "trace" function available in CorelDraw, which is a vector graphics program which can be used to convert a bitmap to a vectored image.

The greater the number of regions 10 into which the depth map is segmented in step S104, the greater the level of three-dimensional detail that will be exhibited in the finished security device. Thus, any number of regions may be utilised but preferably this is at least 3, more preferably at least 5, most preferably at least 10. Depending on the size of the macroimage, there may be an effective limit to the number of regions beyond which the appearance of the device is not significantly improved since the eye can no longer distinguish the regions.

Next, a microimage element array 8 is created for each of the regions 10. These are shown in FIG. 3(*d*) which depicts a first image layer 7 which is made up of the resulting plurality of microimage element arrays. Each microimage array comprises a plurality of substantially identical microimage elements arranged on a regular one-dimensional or two-dimensional grid. In this example, the microimage elements provided in each of the arrays 8 are rectilinear lines. Within each microimage element array, the pitch (spacing) of the microimage elements in constant across the area of the array, and so is the orientation of the microimage elements (i.e. their rotational position in the x-y plane, corresponding to the plane of the security device). However, the pitch and/or orientation of the microimage element is different between any two of the regions 10, with the result that in the finished security device, each region 10 will be visualised at a different depth (along the z-axis, i.e. the normal to the device plane), giving rise to a three-dimensional effect. The achievement of the different apparent depths in each region is due to the moiré magnification mechanism as will be explained below.

In the present example, all of the microimage element arrays have the same orientation (with the rectilinear image elements lying along the y-axis) but their pitch (i.e. spacing in the x-axis direction) varies from one region to the next. As will be explained in more detail below, the closer the microimage element pitch is to the lens pitch, the larger the magnification will be achieved by the moiré effect and hence also the greater the apparent depth. Therefore, in this example (assuming the nearest part of the "A" is behind the surface plane of the device), the greatest depth will be achieved by having the greatest microimage element pitch. The increase in apparent depth is achieved by the pitch of the microimage lines getting closer to the pitch of the lenses. Thus, as shown best in the enlarged portions of FIG. 3(*d*) shown as (i) to (iv), in the first region 10*a*, a first microimage element array 8*a* is formed which has a first pitch $P_1$. In the second region 10*b*, a second microimage element array 8*b* is formed which has a second pitch $P_2$, which is greater than $P_1$. In the third region 10*c*, a third microimage element array 8*c* is formed which has a third pitch $P_3$, which is greater than $P_2$. In the fourth region 10*d*, a fourth microimage element array 8*d* is formed which has a fourth pitch $P_4$, which is greater than $P_3$.

Each microimage element array 8 is arranged to fill an area of a first image layer 7 corresponding to the respective region 10 on which it is based, in terms of its shape and size (and hence periphery), as well as its position relative to the other arrays. In practice, all of the steps just described will typically be carried out using appropriate image manipulation software to create a first image layer template which initially exists digitally, e.g. in a memory of a processor. The first image layer can then be realised using any suitable application technique to apply the pattern defined by the first image layer template to a suitable surface such as that of a substrate. For instance, this may be performed by printing out the template onto such a substrate although alternative techniques will be described below.

In the next step, a sampling element array 25 such as an array of microlenses or a dot screen is provided and arranged to overlap the plurality of microimage element arrays forming the first image layer 7 (step S108). The pitch and orientation of the sampling element array (which is preferably constant across its entire area) is selected such that when the first image layer is viewed via the sampling element array, the microimage elements and sampling elements cooperate to generate magnified versions of the microimage elements due to the moiré effect.

The degree of magnification, and also the apparent depth or height of the magnified images, achieved by moiré magnification is defined by the expressions derived in "The Moire magnifier", M. Hutley, R Hunt, R Stevens & P Savander, Pure Appl. Opt. 3 (1994) pp.133-142. In this explanation, lenses are used as the sampling elements, but the same theory applies to other types of sampling elements including masking elements of which examples will be given below. The only difference is that in the case of focussing elements, the microimages will preferably be located in the focal plane of those elements, whereas for other types of sampling element this is not a requirement. For the avoidance of doubt it should be noted that the terms "height" and "depth" are used in the following explanation interchangeably, since an image's "height" is the same as its "depth" but with a negative value. Both refer to the vertical position v of the image along the z-axis (where the device surface lies in the x-y plane). To summarise the pertinent parts, suppose in one region of the device the microimage element pitch is Pa and the lens array pitch is P* (both pitches lying in the x-axis direction), then the magnification M is given by:

$$M=\mathrm{Pa}/\mathrm{SQRT}[(P^*\cos(\mathrm{Theta})-\mathrm{Pa})^2-(P^*\sin(\mathrm{Theta}))^2]$$

where, Theta equals angle of rotation between the two arrays. For the case where Pa≠P* and where Theta is very small such that cos (Theta)≈1 and sin (Theta)≈0:

$$M=\mathrm{Pa}/(P^*-\mathrm{Pa})=S/(1-S) \quad (1)$$

Where $$S=\mathrm{Pa}/P^*$$

However for large M>>10 then S must≈unity and thus $$M\approx 1/(1-S)$$

The vertical position v of the magnified microimage elements relative to the surface plane derives from the familiar lens equation relating magnification of an image located a distance v from the plane of lens of focal length f, this being:

$$M=v/f-1 \quad (2)$$

Or, since typically v/f>>1

$$M\approx v/f$$

Thus the vertical position v of the synthetically magnified image=M·f

For example, if the lens array 25 were comprised of lenses with a focal length f of 40 microns (0.04 mm), and both the lenses and the supporting substrate were comprised of materials with refractive index n of 1.5, then it follows that the base diameter (width) D of the lenses will constrained by the expression $$D\leq f\cdot 2(n-1) \text{ and therefore } D\leq 0.04\cdot 2(1.5-1), \text{ giving } D\leq 0.04 \text{ mm.}$$

We might then choose a value for D of 0.035 mm and a lens pitch P* of 0.04 mm (along the x axis), resulting in a lens array with a f/# number close to unity with reasonable close packing (inter lens gap 5 microns). In order to obtain an image surface in the region which appears to sit 2 mm below the device surface (i.e. v=2 mm), the necessary pitch Pa of the microimage elements can be calculated as follows:

$$\text{Given } M=v/f, \text{ substituting the above values for v and f, then } M=2/0.04=50.$$

Therefore since M=Pa/(P*−Pa)=50, it follows that 50(P*−Pa)=Pa, giving Pa=P*·(50/51). Substituting P*=0.04 mm, we obtain Pa=0.0392 mm as the pitch in this region needed to give rise to a vertical position v of the image surface of 2 mm.

In a second example, suppose we wish the images in a second region of the device to appear on a flat image plane 6 mm behind the plane of the device. Now, M=6/0.04=150 and thus 150(P*−Pb)=Pb, giving Pb=P*·(150/151)=0.0397 mm. Hence the pitch Pb of the microimage elements in the second region is greater than that in the first region but since this results in a reduction in the pitch mismatch (P*−Pb), the magnification level M is increased and hence so is the apparent image depth.

In other examples, to achieve an image surface height of 6 mm above the device plane, the pitch Pc required is:

$$M=-6/0.04=-150 \text{ and thus } -150(P^*-Pc)=Pc, \text{ giving } Pc=(150/149)P^*=0.0403 \text{ mm.}$$

And, to achieve an image surface height of 2 mm above the device plane the pitch Pd needed is:

$$M=-2/0.04=-50 \text{ and thus } -50(P^*-Pd)=Pd, \text{ giving } Pd=(50/49)P^*=0.0408 \text{ mm.}$$

Hence we see that for the image plane to be located in front of the surface plane $v_0$ (i.e appearing to float) the image slice array 4 must have a pitch larger than the lens pitch P*. Conversely if the image pitch is less than the lens pitch then the image array will appear to be located below the surface plane. Different image plane "depths" can be achieved through the use of different microimage element pitches.

To illustrate the result, FIG. 3(*e*) is a plot showing the apparent depth of the magnified microimage elements in each of the various regions 10. It will be seen that the first region 10*a* is visualised furthest from the viewer (i.e. "deepest"), at depth $D_1$ whilst the fourth region 10*d* appears closest to the viewer, at depth $D_4$ which here corresponds to the plane of the security device itself. The second and third regions 10*b* and 10*c* appear to sit at intermediate depths $D_2$ and $D_3$. Thus in each region 10 the magnified microimage elements appear to form a flat surface parallel to the plane of the device. However in combination the regions sit at different apparent depths and thereby collectively give rise to a three-dimensional representation of the object shown in the macroimage, here the solid letter "A" (step S110).

Whilst in this example the different depths have been achieved through pitch variation, the same result can be achieved instead by varying the orientation of the microimage element arrays from one region to another (i.e. their rotational position in the x-y plane). The mechanism behind this is described in detail in the above-mentioned reference but in essence amounts to the fact that a variation in orientation is analogous to a pitch difference along any one reference direction. Examples will be given below.

It will also be appreciated that, due to the moiré magnification effect, if the resulting security device is tilted, the magnified microimage elements in each region will move laterally relative to the reference frame of the device. In some implementations it may be desirable to exploit this additional effect to enhance the appearance and complexity of the device. However, it may alternatively be preferred to minimise the visibility of this effect so as not to significantly detract from the three-dimensional appearance of the macroimage. This can be achieved by controlling the ultimate size of the magnified microimages, e.g. so that they are not individually distinguishable to the naked eye such as by selecting a small size of the microimage elements themselves and/or a small magnification ratio. Additionally, the choice of microimage element shape will affect the appearance with an array having a uniform overall appearance (e.g. a regular straight line array) producing a plainer and hence less distracting magnified image as opposed that that which will be generated by more complex microimage elements. Preferably, the magnified microimage elements in any one region appear to the naked eye to combine to form a uniform, featureless semi-transparent plane at the desired depth.

Returning to FIG. 2, a preferred method for creating the plurality of microimage element arrays and the first image layer (step 106) is disclosed. The process creates a microimage element array for each region and then digitally stitches them together to form a first image layer template. Thus, in step S106*a*, the desired depth $D_n$ at which the magnified microimages in region n are to be visualised is selected. This could be done manually or by suitably programed software. For example, the desired depth could be selected based on the average colour or tone value of the parts of the depth map which have been grouped into region n. The desired depth $D_n$ could be defined in terms of an absolute value or could be relative to another region of the device (e.g. as a percentage depth).

In step S106*b*, the required pitch and/or orientation needed to achieve the desired visualisation depth $D_n$ is calculated. This may be done with reference to a known or predetermined sampling element array 25 which will be used in the final device, or could be worked out relative to the pitch and/or orientation in another region of the device, e.g. if one is used as a reference region.

A microimage element array is then created by arranging the selected microimage elements (e.g. lines) on a regular grid with the calculated spacing and orientation to form a repeating pattern. The region n in the first image layer template (which defines the shape, size and relative position of each region based on the segmented depth map) is then filled with this pattern in step S106*c*.

Next in step S106*d* the system checks whether there are any more regions to be processed and if so the steps S106*a* to S106*c* are repeated for the next region (n+1). If not, the first image layer template is complete.

All the above steps are typically carried out digitally using suitable software. In step S106*e*, the first image layer 7 itself can then be physically formed in accordance with the template using any application technique which can achieve suitably high resolution. For instance, the first image layer 7 may be formed by printing an ink (preferably of a dark colour and high optical density) onto a suitable substrate, e.g. by gravure printing, lithographic printing or flexographic printing. Alternatively, specialised fine line printing methods may be used such as any of those disclosed in WO-A-2005052650, US 2009/0297805 A1 and WO 2011/102800 A1 or WO 2014/070079 A1.

In still further examples, the microimage elements of the first image layer 7 may be formed as grating structures, recesses or other relief patterns on a substrate, e.g. by embossing or cast-curing into or onto a substrate. A variety of different relief structures can be used as will described in more detail below. Alternatively, the first image layer 7 may be formed by patterning of a metal layer (i.e. demetallisation). Examples of preferred techniques for forming microimage elements in a metal layer are disclosed in our British patent application no. 1510073.8.

It will be appreciated that in all of these examples, the first image layer 7 is monochromatic, i.e. all of the microimage elements themselves are formed in one and the same material. This has the result that the three-dimensional representation of the macroimage generated in the above-described manner will itself be monochromatic. Whilst this will be desirable in some implementations, in other cases it will be preferred to increase the visual impact and complexity of the device through the use of multiple colours and/or tones.

This can be achieved in embodiments of the present invention by further providing the security device with a second image layer 9, as represented by optional method step S112 in FIG. 1. It should be appreciated that whilst this is depicted as occurring at the end of the already-described process, this is not essential and the second image layer 9 could be inserted earlier in the manufacturing process. The second image layer 9 comprises another copy of the macroimage, i.e. depicting the same three-dimensional object 1 as that in the depth map 5. However, the version of the macroimage forming the second image layer is a multi-coloured or multi-tonal version of the macroimage. The level of detail at which the three-dimensional object is depicted may be different (greater or lesser) than that in the depth map 5. The second image layer 9 is arranged to overlap the first image layer so that when both are viewed in combination via the focussing element array 25, a multi-coloured or multi-tonal version of the three-dimensional representation of the object 1 is exhibited. The second image layer 9 effectively contributes colour or tonal variation to the otherwise monochromatic three-dimensional image.

The second colour layer 9 need not be formed at high resolution and can therefore, if desired, be laid down using any convenient application technique including printing methods such as ink jet, laser, thermal diffusion and the like.

Since the layer carries only a macroscale image, which need only be accurate to the naked eye and not under high magnification, only coarse registration (e.g. to 100 microns) between multiple inks forming the layer 9 is required. Similarly, the second image layer 9 is preferably registered to the first image layer but if so again only coarse register is needed.

FIGS. 4(*a*) to (*d*) show four exemplary cross-sections of security devices 20 formed in accordance with embodiments of the invention. The embodiments of FIGS. 4(*a*), (*b*) and (*c*) utilise sampling element arrays in the form of focussing element arrays, whereas that of FIG. 4(*d*) comprises a sampling element array in the form of a masking element array. In the FIG. 4(*a*) example, the first image layer 7 is formed on a transparent polymer substrate 21, e.g. by printing, relief structure formation or demetallisation of a metal layer. The (optional) second image layer 9 is then applied over the top of first image layer 7 so that the two are preferably in direct contact. When viewed through the substrate 21, only those parts of the second image layer 9 not covered by the microimage elements of first image layer 7 are visible. The focussing element array 25 is provided on the other surface of substrate 21 such that the thickness of the substrate 21 corresponds to the optical spacing between the focussing elements and the image layers. Preferably the thickness is configured so as correspond substantially to the focal distance f of the focussing elements so that the image planes are both substantially in the focal plane of the focussing element array. In this example the focussing element array comprises lenses such as cylindrical, spherical or aspherical lenses.

In the FIG. 4(*b*) example, the first image layer 7 is formed on a second substrate 22 which is then affixed to the first substrate 21 which carries the focussing element array as before. The (optional) second image layer 9 could be provided on the same surface of substrate 22 underneath the first image layer, e.g. by printing image layer 9 first followed by applying image layer 7. In this case the second substrate 22 need not be transparent. Alternatively, as in the example shown, the first and second image layers 7, 9 may be formed on opposite surfaces of second substrate 22. In this case at least the first image layer 7 is preferably located in the focal plane of the focussing elements to ensure the three-dimensional image is accurately generated. The second image layer 9 could be located outside the focal plane since a high level of focus is not essential. However, preferably the thickness of second substrate 22 is kept small so as to minimise the loss of focus and also the parallax effect that will be introduced by the additional optical spacing.

The FIG. 4(*c*) embodiment shows an alternative form of focussing element array 25 in which the focussing elements are mirrors rather than lenses. The mirrors may be formed by cast-curing or embossing the focussing relief structure as for lenses, and then depositing a reflective layer such as metal over the relief (not shown). In this case the three-dimensional effect will be seen when the device is viewed from the side of the substrate opposite that carrying the focussing element array and so the (optional) second image layer 9 will need to be at least semi-transparent. In this example the first image layer 7 is shown to be positioned on the same surface of the substrate as the mirrors with their focal length f adjusted accordingly, but it could alternatively be on the opposite side as before.

FIG. 4(*d*) shows an embodiment in which the sampling element array 25 is formed as a masking element array rather than as a focussing element array. The component comprises a substantially opaque layer, formed of a material such as ink, metal or a metal alloy, with gaps therethrough forming substantially transparent zones. The configuration of the transparent and opaque zones will depend on the nature of the device. For example in a one-dimensional moiré magnifier, the transparent and opaque zones may take the form of lines extending along (for example) the z-axis and alternating with one another in one direction (e.g. the x-axis). Each set of one transparent zone and one opaque zone can be considered a masking element, although in practice they may not be individually distinguishable. The result is essentially a line screen, with the transparent zones acting to select different portions of the microimage layer 7 to display to the viewer $O_1$ depending on the viewing angle as a result of parallax. Alternatively the same effect can be achieved in two dimensions by forming the transparent zones as dots arrayed in both the x and y axes.

Masking element arrays 25 such as these can be formed by various techniques, including printing of a suitably opaque material such as a dark ink onto substrate 21 to form the opaque zones, leaving the transparent zones unprinted. Alternatively, the masking element array could be formed of a layer which is deposited all-over and then patterned, e.g. by etching. This is particularly suitable for layers such as metals or alloys which are typically deposited by non-selective methods such as sputtering, vacuum deposition or chemical vapour deposition.

As shown in FIG. 4(*d*), the masking element array 25 is preferably disposed on the opposite surface of substrate 21 from that on which the first and (optional) second image layers 7, 9 are carried, although other arrangements are possible provided there is an optical spacing d between the masking element array 25 and the first image layer 7. Since there is no focal plane in this embodiment, the value of d can be selected depending on the desired optical effect and the required device thickness. The greater the value of d, the smaller angle the device will need to be tilted through to see an optically variable effect.

In all of the above examples, the first image layer 7 lies between the second image layer 9 and the sampling element array 25 as is preferred. However if the second image layer 9 is embodied in a semi-transparent form, this is not essential and the order of the image layers 7, 9 could be reversed. In all cases it is preferred that the microimage elements of the first image layer 7 are of high optical density and preferably opaque so as to create a strong visual effect.

Some further examples of security devices formed using the above principles will now be described. FIG. 5 shows an example in accordance with a second embodiment of the invention, illustrating the images involved at various stages of its manufacture. FIG. 5(*a*) shows the depth map 5 as might be provided in step S102. Here, the three-dimensional object 1 depicted by the macroimage is a scene depicting a table top on which a wine glass and wine bottle are placed. The table extends away from the viewer with the wine bottle being positioned nearer to the viewer than the glass. The depth map 5 is a greyscale depth map representing parts of the object closer to the viewer in light tones (including white) and those further from the viewer in dark tones (including black). The background to the scene constitutes the deepest part of the macroimage in this case.

FIG. 5(*b*) shows the segmented depth map 6 produced by step S104. In this example the depth map has been divided into 11 regions 10*a* to 10*k*, each with a tonal value range of approximately 23, corresponding to about 9% of the overall range in the depth map (255 levels). For instance, the first region 10*a* holds all grey values between 0 to 23, the second region 10*b* all between 24 and 46, and so on.

Figure 2:
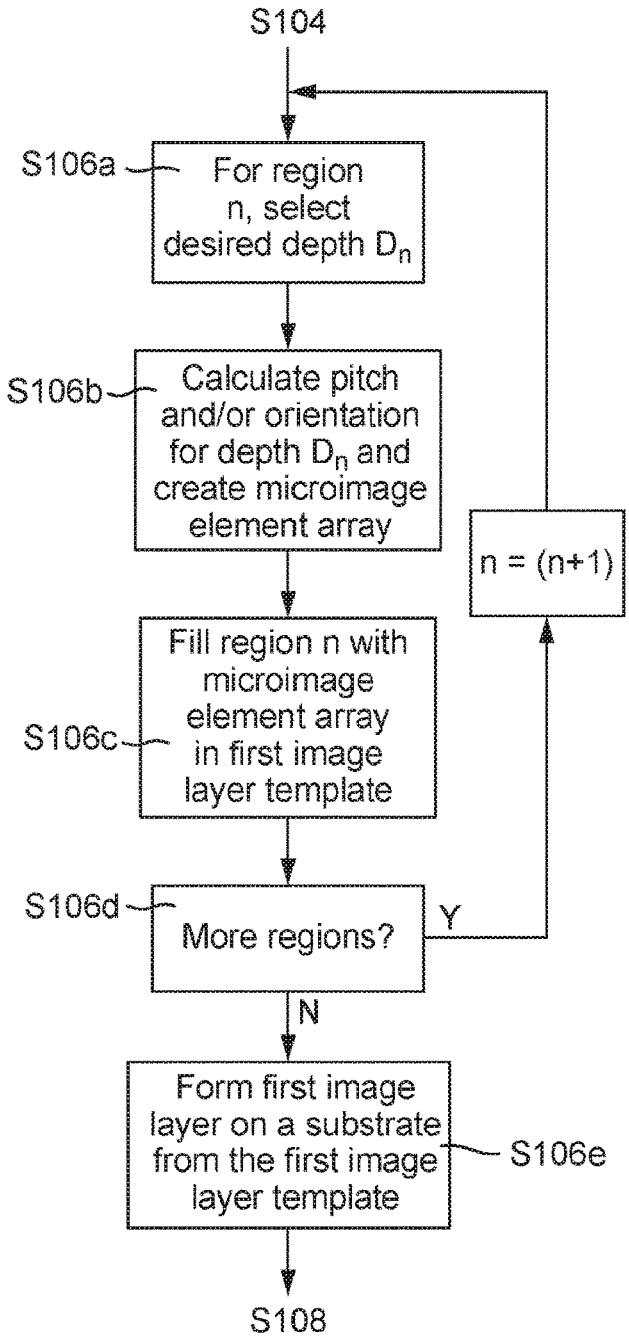
FIG. 2 is a flow chart depicting exemplary steps according to which the first image layer may be formed in the first embodiment.
Figure 3A:
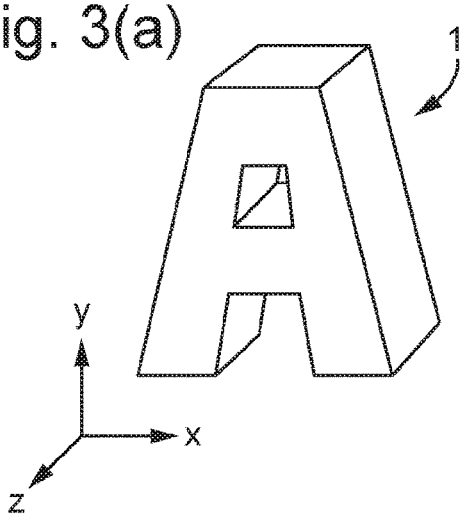
Figure 3B:
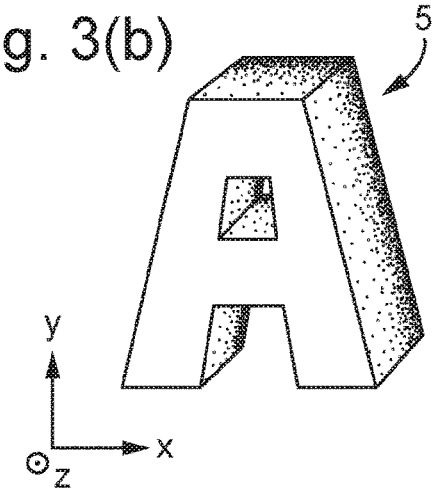
Figure 3C:
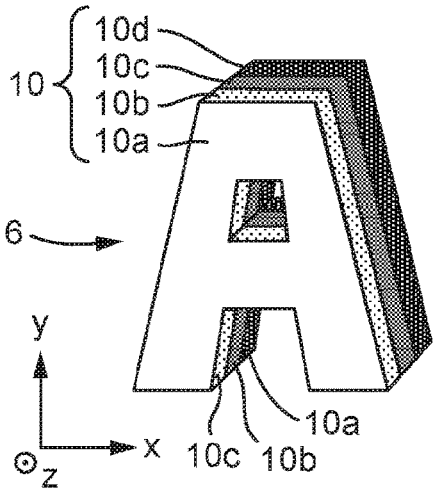
Figure 3D:
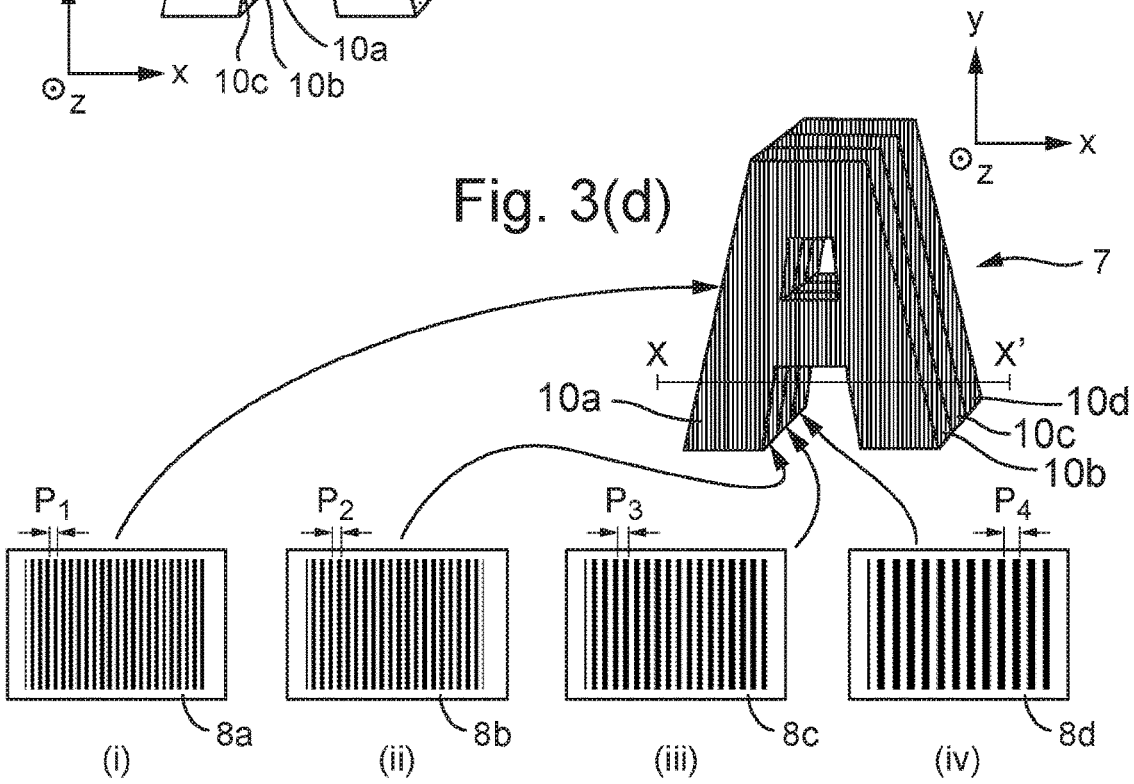
Figure 3E:
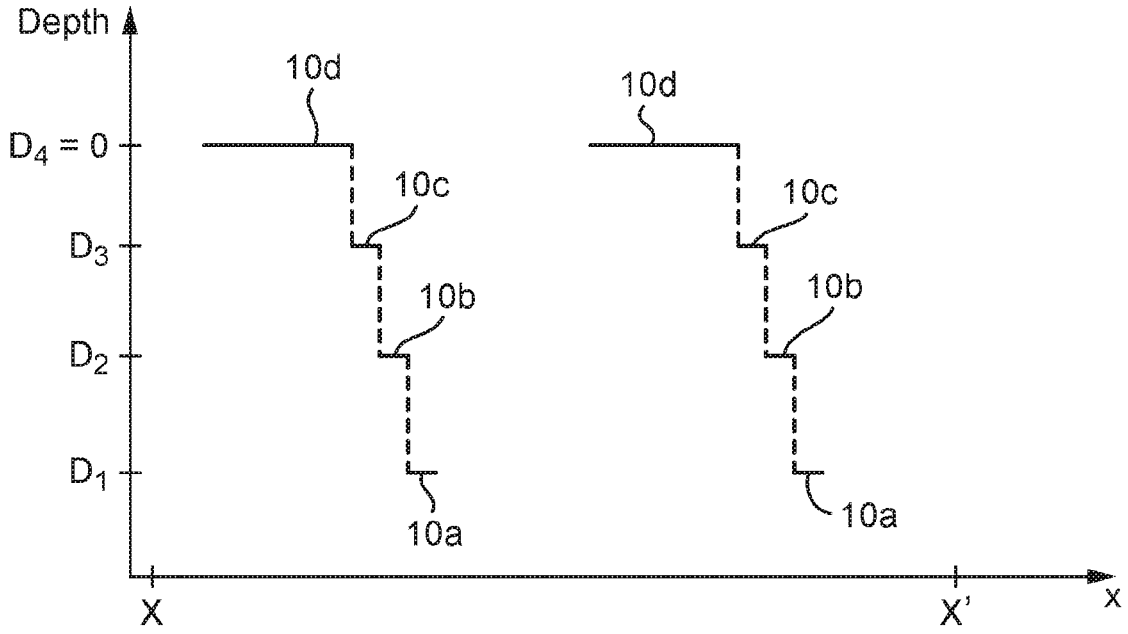
Figure 4A:
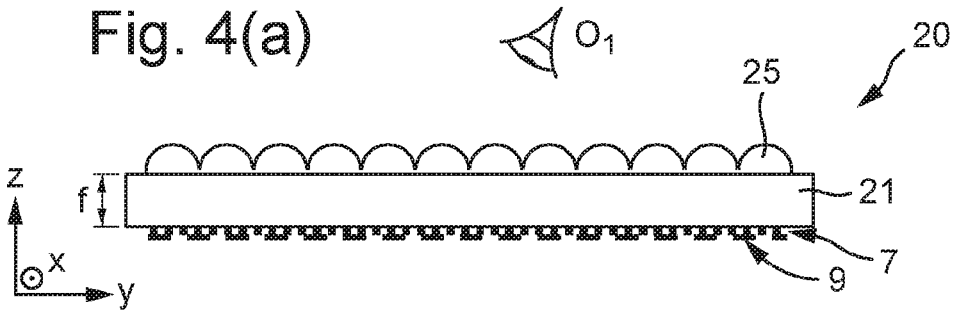
Figure 4B:
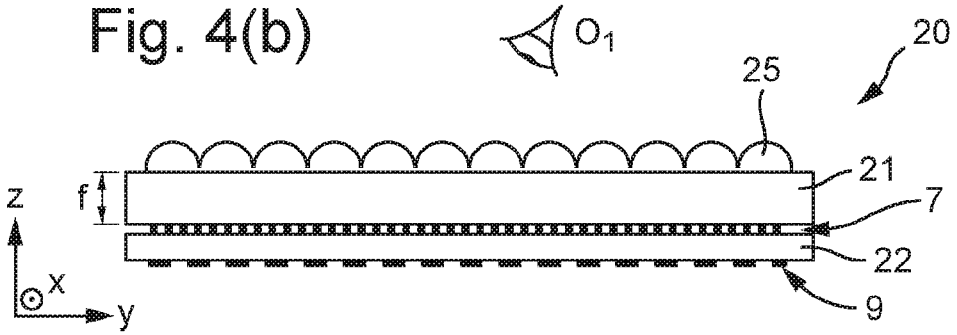
Figure 4C:
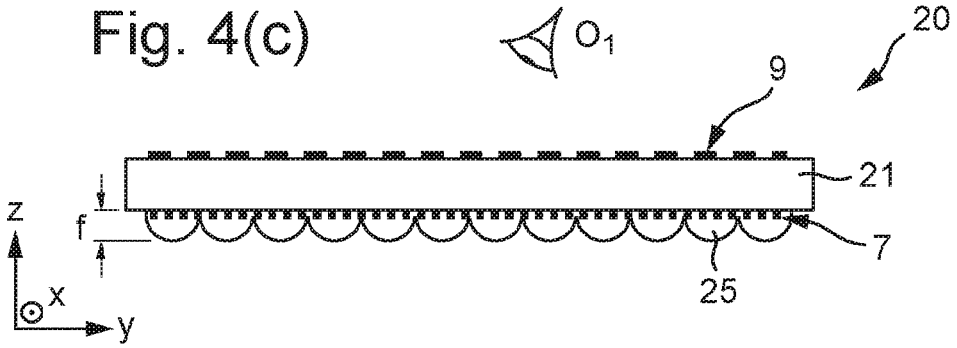
Figure 4D:
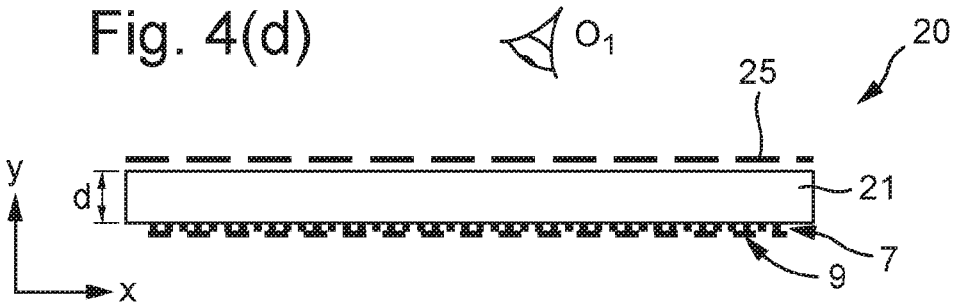
Figure 5A:
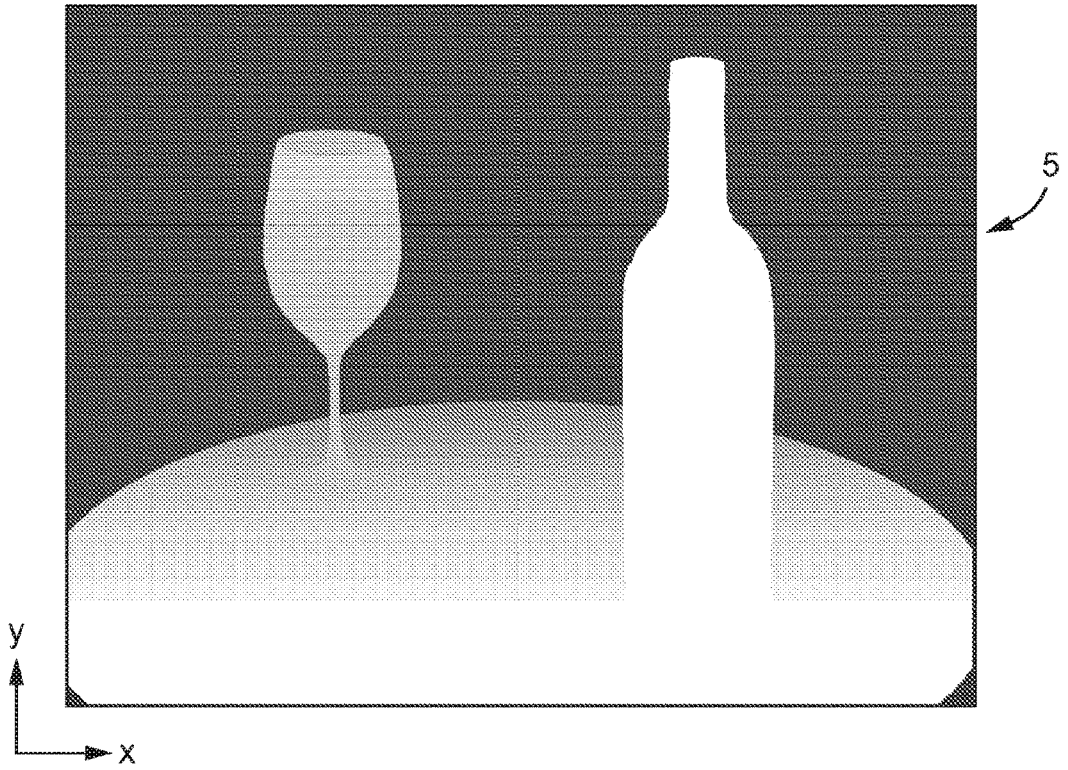
Figure 5B:
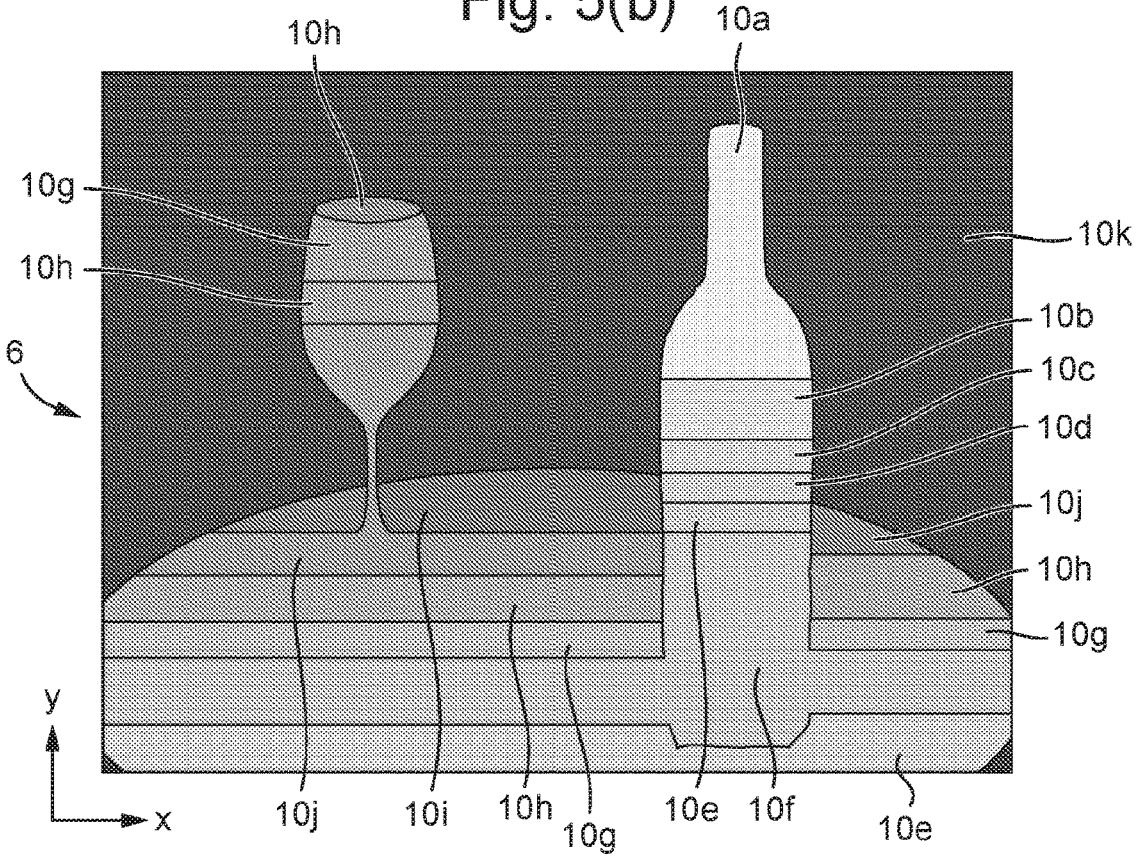
Figure 5C:
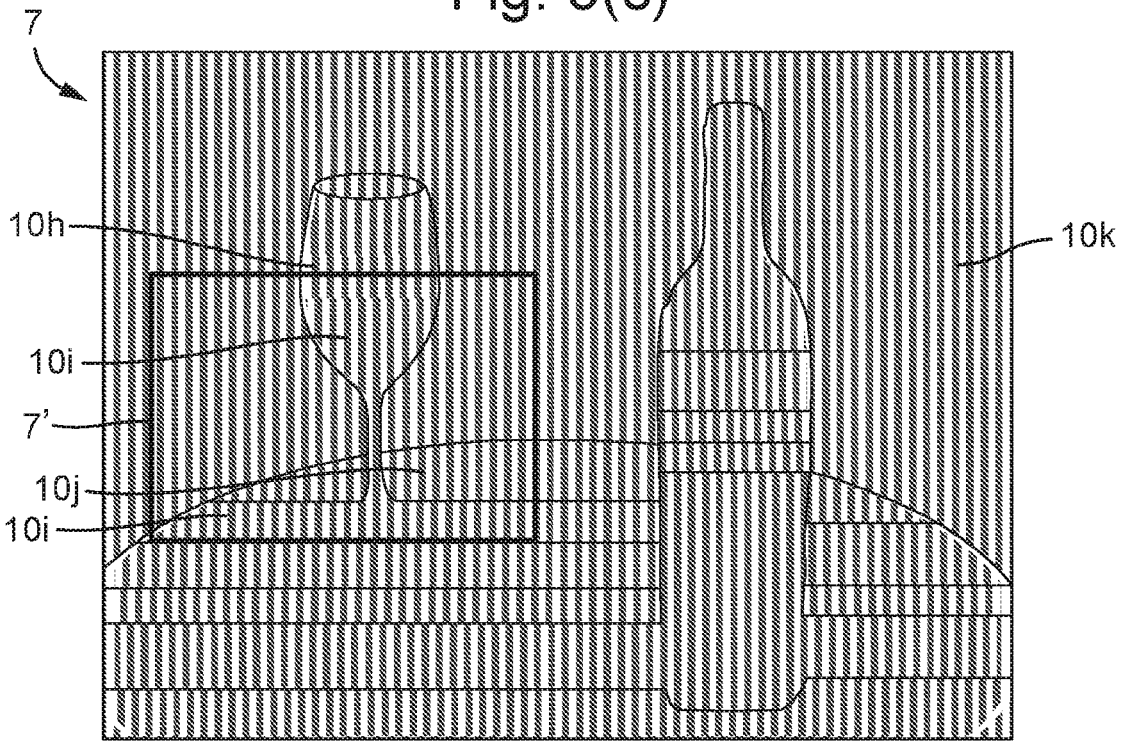
Figure 5D:
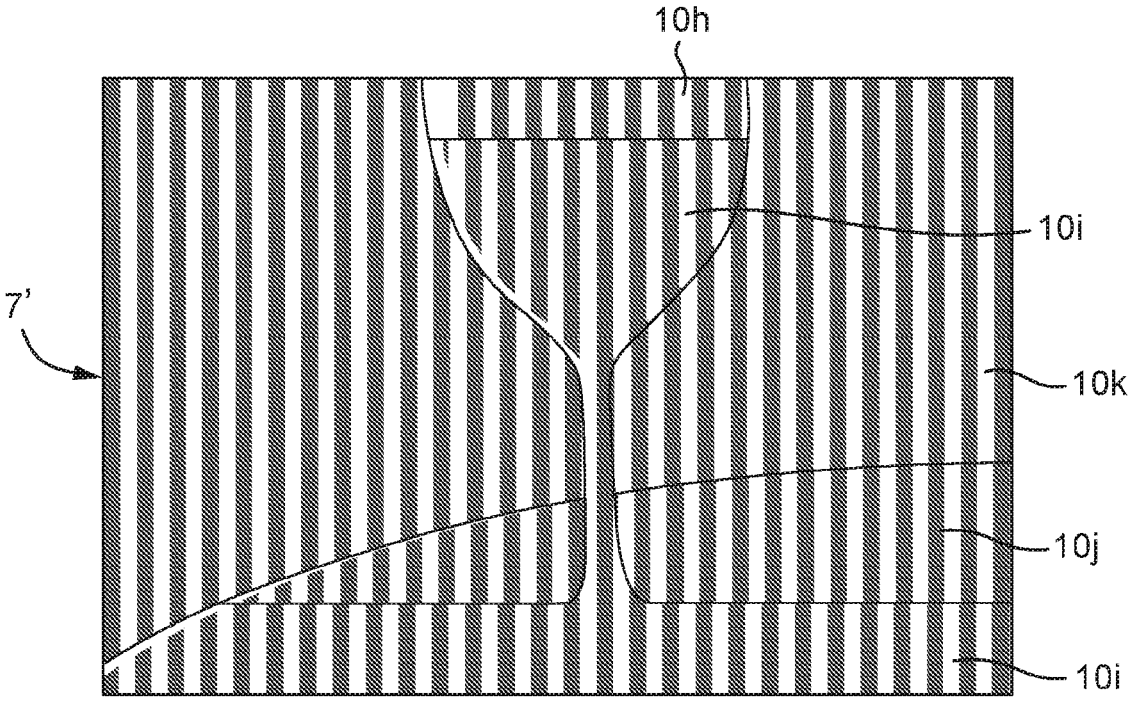
Figure 5E:
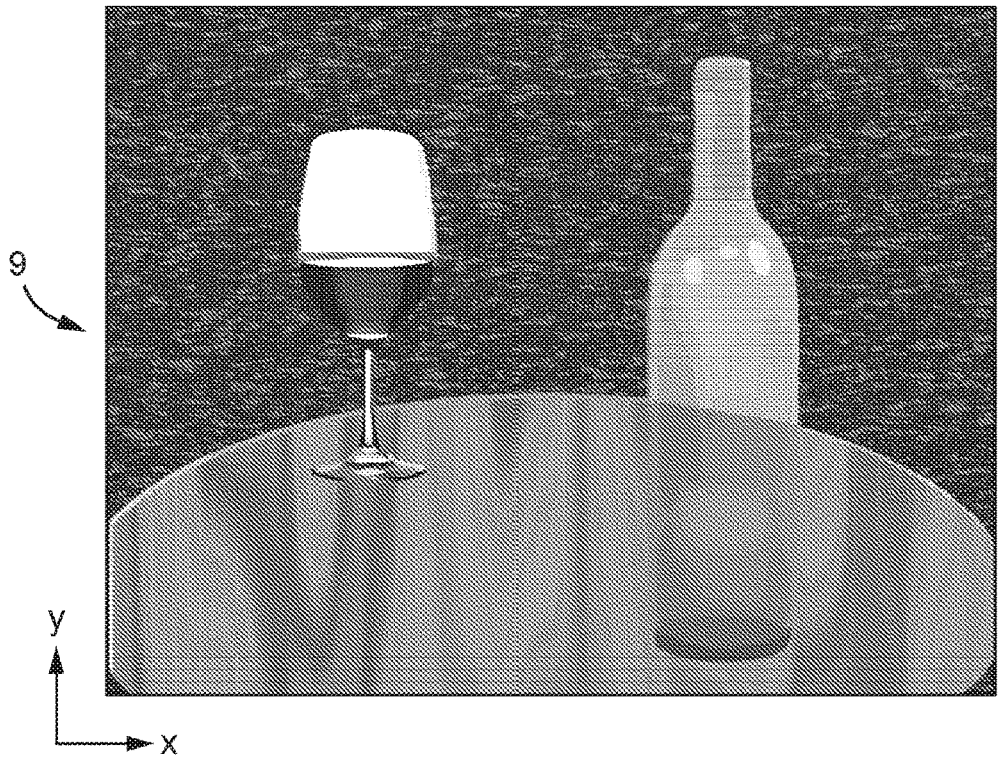
Figure 6A:
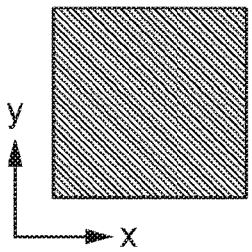
Figure 6B:
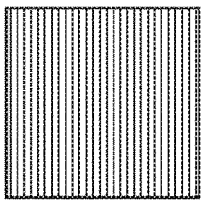
Figure 6C:
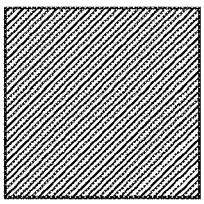
Figure 6D:
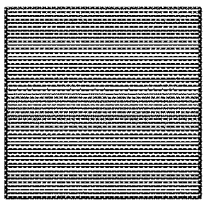

FIG. 5(*c*) illustrates the first image layer 7 formed at the end of step 106 (preferably achieved using the method of FIG. 2). The outlines between regions are shown only for clarity and will typically not be present in reality (although could optionally be provided). As shown more clearly in the enlarged region 7' of the first image layer 7 shown in FIG. 5(*d*), each region 10*a*, 10*b* etc contains a microimage element array of straight line elements. As in the previous example here the orientation is constant across all of the regions but the pitch varies to achieve the different visualisation depths required to recreate the three-dimensional shape of the violin as described above. The so-produced first image layer 7 is formed on a substrate and combined with a focussing element array, e.g. according to any of the structures shown in FIG. 4.

FIG. 5(*e*) depicts an exemplary second image layer 9 which is optionally but preferably included in the device. The second image layer 9 comprises a multi-coloured version of the same macroimage from which the depth map 5 derives and so in this case show the same three-dimensional object 1, i.e. table with wine bottle and wine glass, as before. It will be noted that the level of detail shown is different from that in the depth map 5 since for example the wood grain on the table top is now visible. In other examples, the multi-coloured version of the macroimage could have less detail than the depth map rather than more as in this case. Thus, when the finished security device is viewed, it will exhibit a three-dimensional representation of the table, bottle and glass (contributed by first image layer 7) each of which possesses an appropriate colour (courtesy of the second image layer 9).

As mentioned above, instead of or in addition to varying the pitch of the microimage element arrays from one region to another across the device, the orientation of the arrays can be varied. Exemplary regions having such microimage arrays with different azimuthal angles are shown in FIG. 6 (*a*) to (*d*). Whilst here the exemplary orientations are shown to vary by large angles (45 degrees) this is only diagrammatic and in reality the angular variation will be small (e.g. 1 to 2 degrees at most).

In all the above examples, straight line microimage elements have been used to illustrate the concept. However, the microimage elements in each array could be of any form, e.g. dots, symbols, letters, numbers, curvilinear lines etc. FIG. 7(*a*) to (*c*) shows some illustrative examples. In FIG. 7(*a*) the microimages are ball-shaped indicia, whilst in FIG. 7(*b*) an array of star symbols is used and in FIG. 7(*c*) the microimage elements each form the digit "5". It will be appreciated that the magnified images produced by the moiré effect will simply be larger versions of the microimages themselves. Preferably, the same form of microimage is chosen for each region but this is not essential.

The microimages could be selected to convey information which may be related to the article or document to which the security device is ultimately to be applied, e.g. a denomination value of a banknote. In another particularly preferred example, the microimages convey information related to that conveyed by the macroimage itself. For instance, in the three-dimensional image of the violin shown in FIG. 5, the microimages could be in the form of musical notes (e.g. quaver symbols). In the FIG. 3 example, the microimages could match the content of the macroimage by each carrying the letter "A" (or lower case "a"). Other examples will be mentioned below.

In order to achieve an acceptably low thickness of the security device (e.g. around 70 microns or less where the device is to be formed on a transparent document substrate, such as a polymer banknote, or around 40 microns or less where the device is to be formed on a thread, foil or patch), the pitch of the sampling elements must also be around the same order of magnitude (e.g. 70 microns or 40 microns). Therefore the overall size of each microimage element needs to fall within this range and is preferably no more than half such dimensions, e.g. 35 microns or less.

Figure 8:
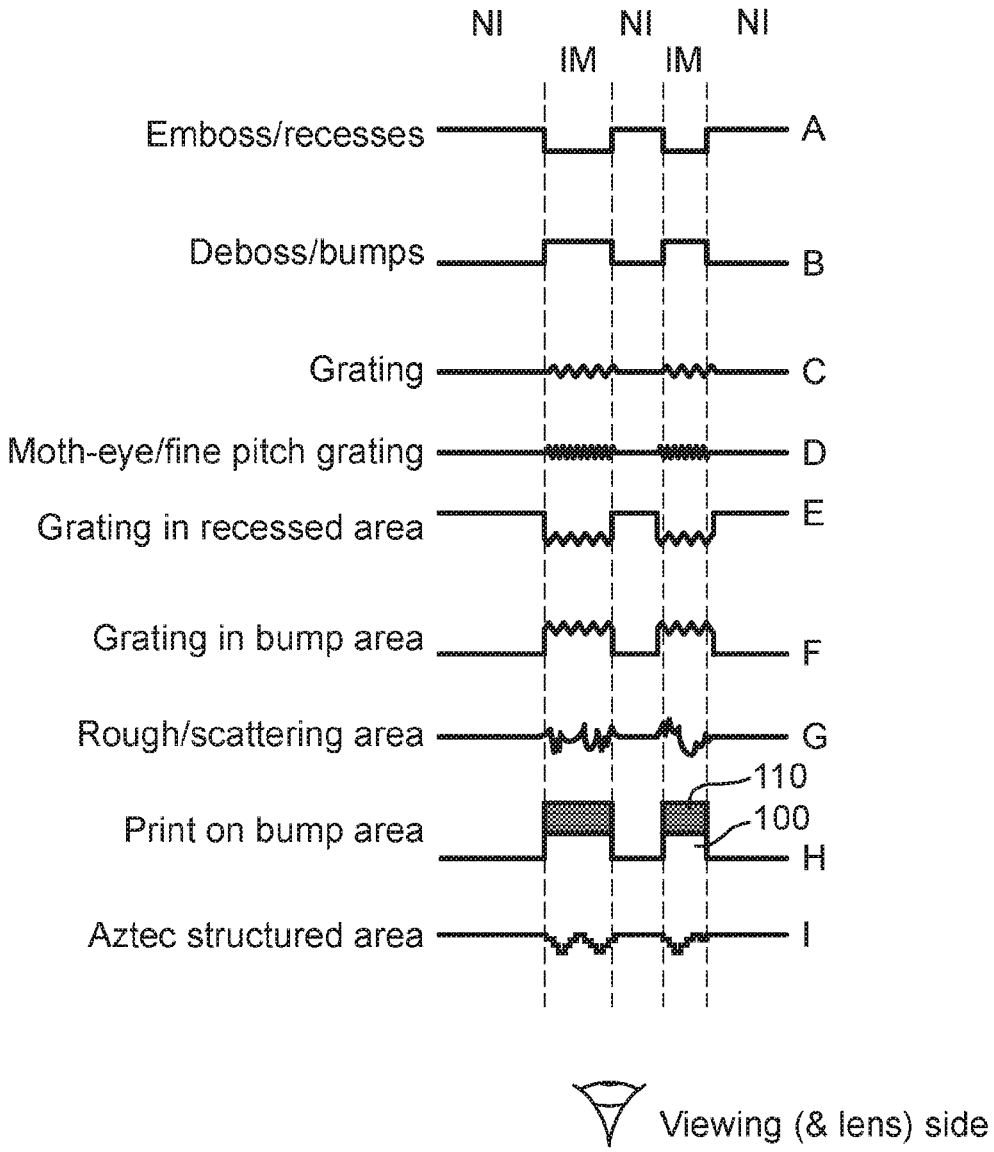

In all of the embodiments, the image elements/slices could be formed in various different ways. For example, the image elements could be formed of ink, for example printed onto the substrate 21 or onto an underlying layer which is then positioned adjacent to the substrate 21. In preferred examples, a magnetic and/or conductive ink could be used for this purpose which will introduce an additional testable security feature to the device. However, in other examples the image elements can be formed by a relief structure and a variety of different relief structure suitable for this are shown in FIG. 8. Thus, FIG. 8*a* illustrates image regions of the microimage elements (IM) in the form of embossed or recessed regions while the non-embossed portions correspond to the non-imaged regions of the elements (NI). FIG. 8*b* illustrates image regions of the elements in the form of debossed lines or bumps.

In another approach, the relief structures can be in the form of diffraction gratings (FIG. 8*c*) or moth eye/fine pitch gratings (FIG. 8*d*). Where the image elements are formed by diffraction gratings, then different image portions of a microimage element, or different microimage elements (e.g. in different regions) can be formed by gratings with different characteristics. The difference may be in the pitch of the grating or rotation. A preferred method for writing such a grating would be to use electron beam writing techniques or dot matrix techniques.

Such diffraction gratings for moth eye/fine pitch gratings can also be located on recesses or bumps such as those of FIGS. 8*a* and b, as shown in FIGS. 8*e* and *f* respectively.

FIG. 8*g* illustrates the use of a simple scattering structure providing an achromatic effect.

Further, in some cases the recesses of FIG. 8*a* could be provided with an ink or the debossed regions or bumps in FIG. 8*b* could be provided with an ink, The latter is shown in FIG. 8*h* where ink layers 110 are provided on the bumps 100. Thus the image areas of each image element could be created by forming appropriate raised regions or bumps in a resin layer provided on a transparent substrate such as item 21 or 22 shown in FIG. 4. This could be achieved for example by cast curing or embossing. A coloured ink is then transferred onto the raised regions typically using a lithographic, flexographic or gravure process. In some examples, some image elements could be printed with one colour and other image elements could be printed with a second colour. In this manner either the magnified images incorporated in the device could be of different colours to one another and/or, when the device is tilted to create the motion effect described above, the magnified images could also be seen to change colour as the regions move along the device. if the parameters are controlled so as to minimise the visibility of the movement effect as mentioned above, this may give the appearance of the overall three-dimensional image appearing to change colour. In another example all of the image elements in one region of the device could be provided in one colour and then all in a different colour in another portion of the device. Again, magnetic and/or conductive ink(s) could be utilised.

Finally, FIG. 8*i* illustrates the use of an Aztec structure.

Additionally, image and non-image areas could be defined by a combination of different element types, e.g. the image areas could be formed from moth eye structures whilst the non-image areas could be formed from gratings.

Alternatively, the image and non-image areas could even be formed by gratings of different pitch or orientation.

Where the image elements are formed solely of grating or moth-eye type structures, the relief depth will typically be in the range 0.05 microns to 0.5 microns. For structures such as those shown in FIGS. 8*a, b, e, f, h* and *i*, the height or depth of the bumps/recesses is preferably in the range 0.5 to 10 μm and more preferably in the range of 1 to 2 μm. The typical width of the bumps or recesses will be defined by the nature of the artwork but will typically be less than 100 μm, more preferably less than 50 μm and even more preferably less than 25 μm. The size of the image elements and therefore the size of the bumps or recesses will be dependent on factors including the type of optical effect required, the size of the focusing elements and the desired device thickness. For example if the width of the focusing elements is 30 μm then each image element may be around 15 μm wide or less.

In still further embodiments the image elements could be formed by demetallisation of a metal later, for instance using any of the methods described in our British Patent Application no. 1510073.8.

In the case of devices having a sampling element array in the form of focussing elements, the pitch of the focussing element array 25 is also indirectly determined by the thickness of the security device. This is because the focal length for a plano-convex lens array (assuming the convex part of the lens is bounded by air and not a varnish) is approximated by the expression $r/(n-1)$, where r is the radius of curvature and n the refractive index of the lens resin. Since the latter has a value typically between 1.45 and 1.5 then we may say the lens focal length approximates to 2r (=w), Now for an array of adjacent cylindrical lenses, the base width of the lens is only slightly smaller than the lens pitch, and since the maximum value the base diameter can have is 2r, it then follows that the maximum value for the lens pitch is close to the value 2r which closely approximates to the lens focal length and therefore the device thickness.

To give an example, for a security thread component as may be incorporated into a banknote, the thickness of the lenticular structure and therefore the lens focal length is desirably less than 35 μm. Let us suppose we target a thickness and hence a focal length of 30 μm. The maximum base width w we can have is from the previous discussion equal to 2r which closely approximates to the lens focal length of 30 μm. In this scenario the f-number, which equals (focal length/lens base diameter), is very close to 1. The lens pitch can be chosen to have a value only a few pm greater than the lens width—let us choose a value of 32 μm for the lens pitch. It therefore follows that the microimage elements need to have dimensions less than this, preferably around half. Such a strip or line width is already well below the resolution of conventional web-based printing techniques such as flexographic, lithographic (wet, waterless & UV) or gravure, which even within the security printing industry have proven print resolutions down to the 50 to 35 μm level at best.

As a result, for ink based printing of the image elements, the f-number of the lens should preferably be minimised, in order to maximise the lens base diameter for a given structure thickness. For example suppose we choose a higher f-number of 3, consequently the lens base width will be 30/3 or 10 μm. Such a lens will be at the boundary of diffractive and refractive physics—however, even if we still consider it to be primarily a diffractive device then the we may assume a lens pitch of say 12 μm. Consider once again the case of a two channel device, now we will need to print an image strip of only about 6 μm and for a four channel device a strip width of only about 3 μm. Conventional printing techniques will generally not be adequate to achieve such high resolution. However, suitable methods for forming the image elements include those described in WO-A-2008/000350, WO-A-2011/102800 and EP-A-2460667.

This is also where using a diffractive structure to provide the image strips provides a major resolution advantage: although ink-based printing is generally preferred for reflective contrast and light source invariance, techniques such as modern e-beam lithography can be used generate to originate diffractive image strips down to widths of 1 μm or less and such ultra-high resolution structures can be efficiently replicated using UV cast cure techniques.

As mentioned above, the thickness of the device is directly related to the size of the sampling elements and so the optical geometry must be taken into account when selecting the thickness of the transparent layer 21. In preferred examples the device thickness is in the range 5 to 200 microns. "Thick" devices at the upper end of this range are suitable for incorporation into documents such as identification cards and drivers licences, as well as into labels and similar. For documents such as banknotes, thinner devices are desired as mentioned above. At the lower end of the range, the limit is set by diffraction effects that arise as the focusing element diameter reduces; e.g. lenses of less than 10 micron base width (hence focal length approximately 10 microns) and more especially less than 5 microns (focal length approximately 5 microns) will tend to suffer from such effects. Therefore the limiting thickness of such structures is believed to lie between about 5 and 10 microns.

In the case of relief structures forming the image elements, these will preferably be embossed or cast cured into a suitable resin layer on the opposite side of the substrate 21 to the sampling element array 25. Where this comprises focussing elements, such as a lens array 25, this itself can also be made using cast cure or embossing processes, or could be printed using suitable transparent substances as described in U.S. Pat. No. 6,856,462. The periodicity and therefore maximum base width of the focusing elements is preferably in the range 5 to 200 μm, more preferably 10 to 60 μm and even more preferably 20 to 40 μm. The f number for the focusing elements is preferably in the range 0.25 to 16 and more preferably 0.5 to 24.

Whilst in most of the above embodiments, the focusing elements have taken the form of lenses, in all cases these could be substituted by an array of focusing mirror elements. Suitable mirrors could be formed for example by applying a reflective layer such as a suitable metal to the cast-cured or embossed lens relief structure. In embodiments making use of mirrors, the image element arrays should be semi-transparent, e.g. having a sufficiently low fill factor to allow light to reach the mirrors and then reflect back through the gaps between the image elements. For example, the fill factor would need to be less than $1\sqrt{2}$ in order that that at least 50% of the incident light is reflected back to the observer on two passes through the image element array.

In all of the embodiments described above, the security level can be increased further by incorporating a magnetic material into the device. This can be achieved in various ways. For example an additional layer may be provided (e.g. under the image element arrays) which may be formed of, or comprise, magnetic material. The whole layer could be magnetic or the magnetic material could be confined to certain areas, e.g. arranged in the form of a pattern or code, such as a barcode. The presence of the magnetic layer could be concealed from one or both sides, e.g. by providing one or more masking layer(s), which may be metal, If the focussing elements are provided by mirrors, a magnetic layer may be located under the mirrors rather than under the image array. If the sampling element array comprises a masking array, the opaque zones (or some of them) could be formed by a magnetic material.

In still preferred cases the magnetic material can be further incorporated into the device by using it in the formation of the image array. For example, in any of the embodiments the microimage elements could be formed using magnetic ink. Alternatively, the image slices could be formed by applying a material defining the required parts of each image slice over a background formed of a layer of magnetic material, provided there is a visual contrast between the two materials.

Security devices of the sort described above can be incorporated into or applied to any article for which an authenticity check is desirable. In particular, such devices may be applied to or incorporated into documents of value such as banknotes, passports, driving licences, cheques, identification cards etc.

The security device or article can be arranged either wholly on the surface of the base substrate of the security document, as in the case of a stripe or patch, or can be visible only partly on the surface of the document substrate, e.g. in the form of a windowed security thread. Security threads are now present in many of the world's currencies as well as vouchers, passports, travellers' cheques and other documents. In many cases the thread is provided in a partially embedded or windowed fashion where the thread appears to weave in and out of the paper and is visible in windows in one or both surfaces of the base substrate. One method for producing paper with so-called windowed threads can be found in EP-A-0059056. EP-A-0860298 and WO-A-03095188 describe different approaches for the embedding of wider partially exposed threads into a paper substrate. Wide threads, typically having a width of 2 to 6 mm, are particularly useful as the additional exposed thread surface area allows for better use of optically variable devices, such as that presently disclosed.

The security device or article may be subsequently incorporated into a paper or polymer base substrate so that it is viewable from both sides of the finished security substrate. Methods of incorporating security elements in such a manner are described in EP-A-1141480 and WO-A-03054297. In the method described in EP-A-1141480, one side of the security element is wholly exposed at one surface of the substrate in which it is partially embedded, and partially exposed in windows at the other surface of the substrate.

Base substrates suitable for making security substrates for security documents may be formed from any conventional materials, including paper and polymer. Techniques are known in the art for forming substantially transparent regions in each of these types of substrate. For example, WO-A-8300659 describes a polymer banknote formed from a transparent substrate comprising an opacifying coating on both sides of the substrate. The opacifying coating is omitted in localised regions on both sides of the substrate to form a transparent region. In this case the transparent substrate can be an integral part of the security device or a separate security device can be applied to the transparent substrate of the document. WO-A-0039391 describes a method of making a transparent region in a paper substrate, Other methods for forming transparent regions in paper substrates are described in EP-A-723501, EP-A-724519, WO-A-03054297 and EP-A-1398174.

The security device may also be applied to one side of a paper substrate so that portions are located in an aperture formed in the paper substrate. An example of a method of producing such an aperture can be found in WO-A-03054297. An alternative method of incorporating a security element which is visible in apertures in one side of a paper substrate and wholly exposed on the other side of the paper substrate can be found in WO-A-2000/39391.

Examples of such documents of value and techniques for incorporating a security device will now be described with reference to FIGS. 9 to 12. In all of these examples, the sampling element array 25 is depicted as a lens array, but this could be replaced by another type of sampling element array such as a masking element array as discussed above.

FIG. 9 depicts an exemplary document of value 50, here in the form of a banknote. FIG. 9*a* shows the banknote in plan view whilst FIG. 9*b* shows the same banknote in cross-section along the line Q-Q'. In this case, the banknote is a polymer (or hybrid polymer/paper) banknote, having a transparent substrate 51. Two opacifying layers 52*a* and 52*b* are applied to either side of the transparent substrate 51, which may take the form of opacifying coatings such as white ink, or could be paper layers laminated to the substrate 51.

The opacifying layers 52*a* and 52*b* are omitted across an area 55 which forms a window within which the security device is located. As shown best in the cross-section of FIG. 9*b*, an array of focusing elements 25 is provided on one side of the transparent substrate 51, and a corresponding first image layer 7 is provided on the opposite surface of the substrate. The focusing element array 25 and first image layer 7 are each as described above with respect to any of the disclosed embodiments, such that a three-dimensional representation M of a macroimage is displayed. It should be noted that in modifications of this embodiment the window 55 could be a half-window with the opacifying layer 52*b* continuing across all or part of the window over the image element array 57, In this case, the window will not be transparent but may (or may not) still appear relatively translucent compared to its surroundings. This exemplary banknote also carries a second security device 59 again formed as described in any of the preceding embodiments, which here is applied to the outer surface of a non-windowed portion of the banknote, e.g. as a patch. The banknote may also comprise a series of windows or half-windows, In this case the different regions displayed by the security device could appear in different ones of the windows, at least at some viewing angles, and could move from one window to another upon tilting.

FIG. 10 shows such an example, although here the banknote 50 is a conventional paper-based banknote provided with a security article 60 in the form of a security thread, which is inserted during paper-making such that it is partially embedded into the paper so that portions of the paper 53 and 54 lie on either side of the thread. This can be done using the techniques described in EP0059056 where paper is not formed in the window regions during the paper making process thus exposing the security thread in is incorporated between layers 53 and 54 of the paper. The security thread 60 is exposed in window regions 65 of the banknote. Alternatively the window regions 65 which may for example be formed by abrading the surface of the paper in these regions after insertion of the thread. The security device is formed on the thread 60, which comprises a transparent substrate 63 with lens array 25 provided on one side and first image layer 7 provided on the other. In the illustration, the lens array 25 is depicted as being discontinuous between each exposed region of the thread, although in practice typically this will not be the case and the security device will be formed continuously along the thread. In this example, different three-dimensional images $M_1$, $M_2$ and $M_3$ are displayed in each window 65. For instance, in the top window the image $M_1$ is of a geometrical solid, here a pyramid, in the middle window the image $M_2$ is of a person, here a portrait of the Queen, and in the bottom window the image $M_3$ is of a building. The microimages used to form the first image layer 7 could be different for each image and preferably conceptually related, e.g. an Egyptian hieroglyph for pyramid $M_1$, the letters "QEII" for portrait $M_2$ and so on.

In FIG. 11, the banknote 50 is again a conventional paper-based banknote, provided with a strip element or insert 60. The strip 60 is based on a transparent substrate 63 and is inserted between two plies of paper 53 and 54. The security device is formed by a lens array 25 on one side of the strip substrate 63, and a first image layer 7 on the other. The paper plies 53 and 54 are apertured across region 65 to reveal the security device, which in this case may be present across the whole of the strip 60 or could be localised within the aperture region 65.

A further embodiment is shown in FIG. 12 where FIGS. 12(*a*) and (*b*) show the front and rear sides of the document respectively, and FIG. 12(*c*) is a cross section along line Z-Z'. Security article 60 is a strip or band comprising a security device according to any of the embodiments described above. The security article 60 is formed into a security document 50 comprising a fibrous substrate 53, using a method described in EP-A-1141480. The strip is incorporated into the security document such that it is fully exposed on one side of the document (FIG. 12(*a*)) and exposed in one or more windows 65 on the opposite side of the document (FIG. 12(*b*)). Again, the security device is formed on the strip 60, which comprises a transparent substrate 63 with a lens array 25 formed on one surface and first image layer 7 formed on the other.

In FIG. 12, the document of value 50 is again a conventional paper-based banknote and again includes a strip dement 60. In this case there is a single ply of paper. Alternatively a similar construction can be achieved by providing paper 53 with an aperture 65 and adhering the strip element 60 is adhered on to one side of the paper 53 across the aperture 65. The aperture may be formed during papermaking or after papermaking for example by die-cutting or laser cutting. Again, the security device is formed on the strip 60, which comprises a transparent substrate 63 with a lens array 25 formed on one surface and first image layer 7 formed on the other.

In general, when applying a security article such as a strip or patch carrying the security device to a document, it is preferable to have the side of the device carrying the image element array bonded to the document substrate and not the lens side, since contact between lenses and an adhesive can render the lenses inoperative. However, the adhesive could be applied to the lens array as a pattern that the leaves an intended windowed zone of the lens array uncoated, with the strip or patch then being applied in register (in the machine direction of the substrate) so the uncoated lens region registers with the substrate hole or window It is also worth noting that since the device only exhibits the optical effect when viewed from one side, it is not especially advantageous to apply over a window region and indeed it could be applied over a non-windowed substrate. Similarly, in the context of a polymer substrate, the device is well-suited to arranging in half-window locations.

The invention claimed is:

1. A method of manufacturing a security device, comprising:

a) providing a depth map of a macroimage depicting a three-dimensional object, the depth map representing a depth of each part of the three-dimensional object relative to a reference plane by means of different colours and/or different tones of one colour;

b) segmenting the depth map into a plurality of regions based on the colours and/or tones of the depth map, each region comprising those part(s) of the depth map having a colour or tonal value within a respective predetermined range;

c) for each region, creating a respective microimage element array, the microimage elements forming the microimage element array being arranged on a periodic grid in one or two dimensions with a pitch and orientation which are constant across the region, a periphery of the microimage element array substantially matching that of the region, the resulting plurality of microimage element arrays being arranged relative to one another in positions of the respective regions in the depth map to form a first image layer; and d) providing a sampling element array of a predetermined pitch and orientation, the sampling element array overlapping the plurality of microimage element arrays, wherein the pitches of the sampling element array and of the microimage element arrays and their relative locations are such that the sampling element array cooperates with each of the microimage element arrays to generate magnified versions of the microimage elements in each region due to a moiré effect;

wherein the pitch and/or orientation of each respective microimage element array is different, and is configured such that the magnified versions of the microimage elements generated in any one of the regions have a different apparent depth relative to those generated in the other region(s), so as to form a three-dimensional representation of the macroimage.

2. A method according to claim 1, further comprising providing a second image layer in the form of a multi-coloured or multi-tonal version of the macroimage, and overlapping the second image layer with the first image layer so as to provide the three-dimensional representation of the macroimage with a multi-coloured or multi-tonal appearance.

3. A method according to claim 2, wherein the first image layer is located between the sampling element array and the second image layer.

4. A method according to claim 1, wherein the depth map is a greyscale depth map, lighter grey tones representing parts of the object closer to a viewer and darker grey tones representing parts of the object further from the viewer, or vice versa.

5. A method according to claim 1, wherein in step (b) the depth map is segmented into at least 3 regions.

6. A method according to claim 1, wherein in step (b) a magnitude of the predetermined colour or tonal value range for each region is approximately equal.

7. A method according to claim 1, wherein the first image layer is monochromatic.

8. A method according to claim 1 wherein the pitch and orientation of the sampling element array is constant across all of the regions.

9. A method according to claim 1, wherein the sampling element array comprises a focussing element array defining a focal plane, and step (d) further comprises locating the first image layer in a plane substantially coincident with the focal plane of the focussing element array.

10. A method according to claim 1, wherein the sampling element array comprises a mask element array, each mask element comprising at least one substantially opaque zone and at least one substantially transparent zone.

11. A security device, comprising:

a sampling element array defining a focal plane and having a predetermined pitch and orientation;

a first image layer overlapping the sampling element array; and a second image layer overlapping the sampling element array and the first image layer and arranged such that the first and second image layers are viewed in combination with one another via the sampling element array, the second image layer comprising a multi-coloured or multi-tonal version of a macroimage depicting a three-dimensional object;

wherein the first image layer comprises a plurality of regions each being formed of a respective microimage element array, the microimage elements forming the microimage element array within each region being arranged on a periodic grid in one or two dimensions with a pitch and orientation which are constant across the region, a periphery of each microimage element array substantially matching that of the respective region;

wherein the pitches of the sampling element array and of the microimage element arrays and their relative locations are such that the sampling element array cooperates with each of the microimage element arrays to generate magnified versions of the microimage elements in each region due to a moiré effect;

wherein the pitch and/or orientation of each respective microimage element array is different, and is configured such that the magnified versions of the microimage elements generated in any one of the regions have a different apparent depth relative to those generated in the other region(s), so as to form a three-dimensional representation of the macroimage, the second image layer providing the three-dimensional representation of the macroimage with a multi-coloured or multi-tonal appearance.

12. A security device according to claim 11, wherein the first image layer is located between the sampling element array and the second image layer.

13. A security device according to claim 11, wherein the plurality of regions comprises at least 3 regions.

14. A security device according to claim 11, wherein the first image layer is monochromatic.

15. A security device according to claim 11 wherein the pitch and orientation of the sampling element array is constant across all of the regions.

16. A security device according to claim 11, wherein the sampling element array comprises a focussing element array defining a focal plane, and the first image layer is located in a plane substantially coincident with the focal plane of the focussing element array.

17. A security device according to claim 11, wherein the sampling element array comprises a mask element array, each mask element comprising at least one substantially opaque zone and at least one substantially transparent zone.

18. A security article comprising a security device according to claim 11, wherein the security article is a security thread, strip, foil, insert, transfer element, label or patch.

19. A security document comprising a security device according to claim 11, or a security article comprising the security device, wherein the article is a security thread, strip, foil, insert, transfer element, label or patch; and wherein the security document is a banknote, cheque, passport, identity card, driver's licence, certificate of authenticity, fiscal stamp or other document for securing value or personal identity.

* * * * *